US010010486B2

(12) United States Patent
Nazginov

(10) Patent No.: US 10,010,486 B2
(45) Date of Patent: Jul. 3, 2018

(54) ADJUSTABLE INDICATORS FOR CONTAINER ASSEMBLIES

(71) Applicant: Arthur Nazginov, Kew Gardens Hills, NY (US)

(72) Inventor: Arthur Nazginov, Kew Gardens Hills, NY (US)

( * ) Notice: Subject to any disclaimer, the term of this patent is extended or adjusted under 35 U.S.C. 154(b) by 770 days.

(21) Appl. No.: 14/533,924

(22) Filed: Nov. 5, 2014

(65) Prior Publication Data

US 2016/0120760 A1 May 5, 2016

(51) Int. Cl.

| | |
|---|---|
| ***A61J 7/00*** | (2006.01) |
| ***A61J 7/04*** | (2006.01) |
| ***A61J 1/03*** | (2006.01) |
| ***B65D 83/04*** | (2006.01) |

(52) U.S. Cl.

CPC ..... *A61J 7/0481* (2013.01); *A61J 1/03* (2013.01); *B65D 83/04* (2013.01)

(58) Field of Classification Search

CPC .... A61J 7/0481; A61J 1/03; A61J 7/04; A61J 7/0436; B65D 83/04; B65D 51/24

USPC ..... 215/230

See application file for complete search history.

(56) References Cited

U.S. PATENT DOCUMENTS

| | | | | |
|---|---|---|---|---|
| 261,131 | A | 7/1882 | Bonshire | |
| 3,151,599 | A | 10/1964 | Livingston | |
| 3,355,067 | A | 11/1967 | Martin | |
| 3,446,179 | A | 5/1969 | Samuel | |
| 3,753,417 | A | 8/1973 | Garby | |
| 4,365,722 | A | 12/1982 | Kramer | |
| 4,432,300 | A * | 2/1984 | Lyss | A61J 7/04 116/308 |
| 4,489,834 | A * | 12/1984 | Thackrey | A61J 7/04 116/308 |
| 4,705,182 | A | 11/1987 | Newel-Lewis | |
| 4,753,189 | A * | 6/1988 | Mastman | A61J 7/04 116/308 |
| 4,756,423 | A * | 7/1988 | Holtsch | A61J 7/04 116/308 |
| 5,184,739 | A | 2/1993 | Kusz | |
| 5,279,422 | A * | 1/1994 | Adams | A61J 7/04 116/308 |
| 5,299,701 | A | 4/1994 | Barker et al. | |

(Continued)

FOREIGN PATENT DOCUMENTS

| | | |
|---|---|---|
| JP | 49-003453 | 4/1974 |
| JP | H03-21250 B2 | 1/1991 |
| JP | 2000-514222 A | 10/2000 |

*Primary Examiner* — Ernesto Grano

(74) *Attorney, Agent, or Firm* — Van Court & Aldridge LLP

(57) ABSTRACT

Adjustable indicators for containers and methods for using and making the same are provided. In one example embodiment, a cap for a bottle includes a closure operative to be coupled to the bottle for closing the bottle, a base coupled to the closure, a dial positioned between a portion of the base and a portion of the closure, and a gear assembly positioned between a portion of the base and a portion of the dial. The gear assembly includes a dial gear subassembly coupled to the dial and a user gear subassembly, wherein the gear assembly is operative to translate movement of the user gear subassembly into movement of the dial gear subassembly for moving the dial with respect to the closure. Additional embodiments are also provided.

15 Claims, 15 Drawing Sheets

(56) References Cited

U.S. PATENT DOCUMENTS 5,356,012 A 10/1994 Tang et al.
5,421,482 A 6/1995 Garby et al.
5,638,970 A 6/1997 Garby et al.
5,927,528 A 7/1999 Jones
5,984,122 A * 11/1999 Barker ..... A61J 7/02 116/308
5,988,496 A 11/1999 Bruna
6,076,521 A * 6/2000 Lindahl ..... A61M 15/0065 128/200.23
6,082,358 A * 7/2000 Scarrott ..... A61M 15/0065 128/200.14
6,779,480 B2 * 8/2004 Zamjahn ..... G09F 11/23 116/308
6,789,497 B1 * 9/2004 Aiken ..... G09F 11/23 116/308
7,000,791 B2 * 2/2006 Miller ..... A61J 7/04 206/534
7,017,762 B2 * 3/2006 Shane ..... A61J 7/04 215/230
7,222,736 B1 * 5/2007 Seijas ..... A61J 7/04 116/308
7,584,712 B2 * 9/2009 Lu ..... A61M 15/009 116/284
7,637,227 B2 * 12/2009 Stradella ..... G01F 11/006 116/298
7,857,134 B2 * 12/2010 Koch ..... A61J 7/04 206/459.1
7,878,350 B2 2/2011 Ramoundos
8,082,873 B2 12/2011 Nuttall
8,579,116 B2 11/2013 Pether et al.
8,662,330 B2 * 3/2014 Simpson ..... B65D 55/145 215/201
8,763,553 B1 * 7/2014 Shannehan ..... A61J 7/04 116/308
8,857,617 B2 10/2014 Balakier et al.
8,931,652 B2 * 1/2015 Simpson ..... B65D 55/145 215/201
8,938,999 B2 * 1/2015 Dahl ..... B65D 55/145 70/158
9,492,356 B2 * 11/2016 Balakier ..... A61J 7/04
9,622,939 B2 * 4/2017 Buxton-Dakides ..... A61J 1/03
2003/0089145 A1 * 5/2003 Michels ..... B65D 55/14 70/169
2004/0206295 A1 10/2004 Zamjahn
2006/0124501 A1 * 6/2006 McNeely ..... A61J 7/04 206/534
2006/0139151 A1 * 6/2006 Rosche ..... A61J 7/0481 340/309.16
2006/0207958 A1 * 9/2006 Hamer ..... B65D 55/145 215/206
2007/0056502 A1 3/2007 Lu
2008/0128381 A1 6/2008 Ramoundos
2008/0173666 A1 * 7/2008 Coe ..... B65D 83/0409 221/265
2010/0142330 A1 * 6/2010 Reygaert ..... A61J 7/0481 368/10
2011/0210136 A1 * 9/2011 Wang ..... B65D 55/145 220/831
2011/0284415 A1 11/2011 Balakier et al.
2012/0223045 A1 * 9/2012 Burke, Jr. ..... A61J 7/0472 215/228
2013/0292354 A1 11/2013 Xu et al.
2015/0008152 A1 * 1/2015 Xu ..... A61J 1/03 206/538
2017/0137190 A1 * 5/2017 Simpson ..... B65D 55/145
2017/0198830 A1 7/2017 Doughty et al.
2017/0202748 A1 * 7/2017 Gosselin ..... A61J 7/0436

* cited by examiner

100

100

100

100

170

100

200

300

400

500

600

600

700

700

800

ADJUSTABLE INDICATORS FOR CONTAINER ASSEMBLIES

TECHNICAL FIELD

This disclosure relates to adjustable indicators for container assemblies and, more particularly, to adjustable indicators for closures of medicine bottle containers that keep track of medication schedules, as well as methods for using and making the same.

BACKGROUND OF THE DISCLOSURE

Various containers are used to hold medicine or other contents that must be used in a sensitive fashion (e.g., according to a strict medication schedule). Some containers are provided with indicators that may inform a user about the manner in which the contents ought to be used. However, safely and securely managing the variable information of such indicators has heretofore been infeasible.

SUMMARY OF THE DISCLOSURE

This document describes adjustable indicators for containers and methods for using and making the same.

As an example, a cap for a bottle may include a closure operative to be coupled to the bottle for closing the bottle. The closure may include a closure body defining a closure space and a closure passageway provided through the closure body. The cap may also include a base including a base body coupled to the closure body within the closure space, where the base body and the closure body define an indicia space within the closure space. The cap may also include a dial including a dial body positioned within the indicia space. The cap may also include a gear assembly positioned within the indicia space between a portion of the base body and a portion of the dial body. The gear assembly may include a dial gear subassembly including a dial gear coupled to the dial body, and a user gear subassembly including a user gear and a user shaft extending away from the user gear. Rotation of the user shaft is operative to rotate the user gear, rotation of the user gear is operative to rotate the dial gear, rotation of the dial gear is operative to rotate the dial body, and rotation of the dial body is operative to change the portion of the dial body that is aligned with the closure passageway.

As another example, a cap for a bottle may include a closure operative to be coupled to the bottle for closing the bottle, a base coupled to the closure, a dial positioned between a portion of the base and a portion of the closure, and a gear assembly positioned between a portion of the base and a portion of the dial. The gear assembly may include a dial gear subassembly coupled to the dial, and a user gear subassembly. The gear assembly is operative to translate movement of the user gear subassembly into movement of the dial gear subassembly for moving the dial with respect to the closure.

As yet another example, a method for changing the portion of indicia on a dial within a bottle cap that is visible to a user through a passageway in the bottle cap may include pushing a user gear along a first axis towards a dial gear that is coupled to the dial. During the pushing, the method may also include rotating the user gear about the first axis. The method may also include rotating the dial gear and the dial about a second axis using the rotation of the user gear.

This Summary is provided merely to summarize some example embodiments, so as to provide a basic understanding of some aspects of the subject matter described in this document. Accordingly, it will be appreciated that the features described in this Summary are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

The discussion below makes reference to the following drawings, in which like reference characters may refer to like parts throughout, and in which.

DETAILED DESCRIPTION OF THE DISCLOSURE

Figure 1:
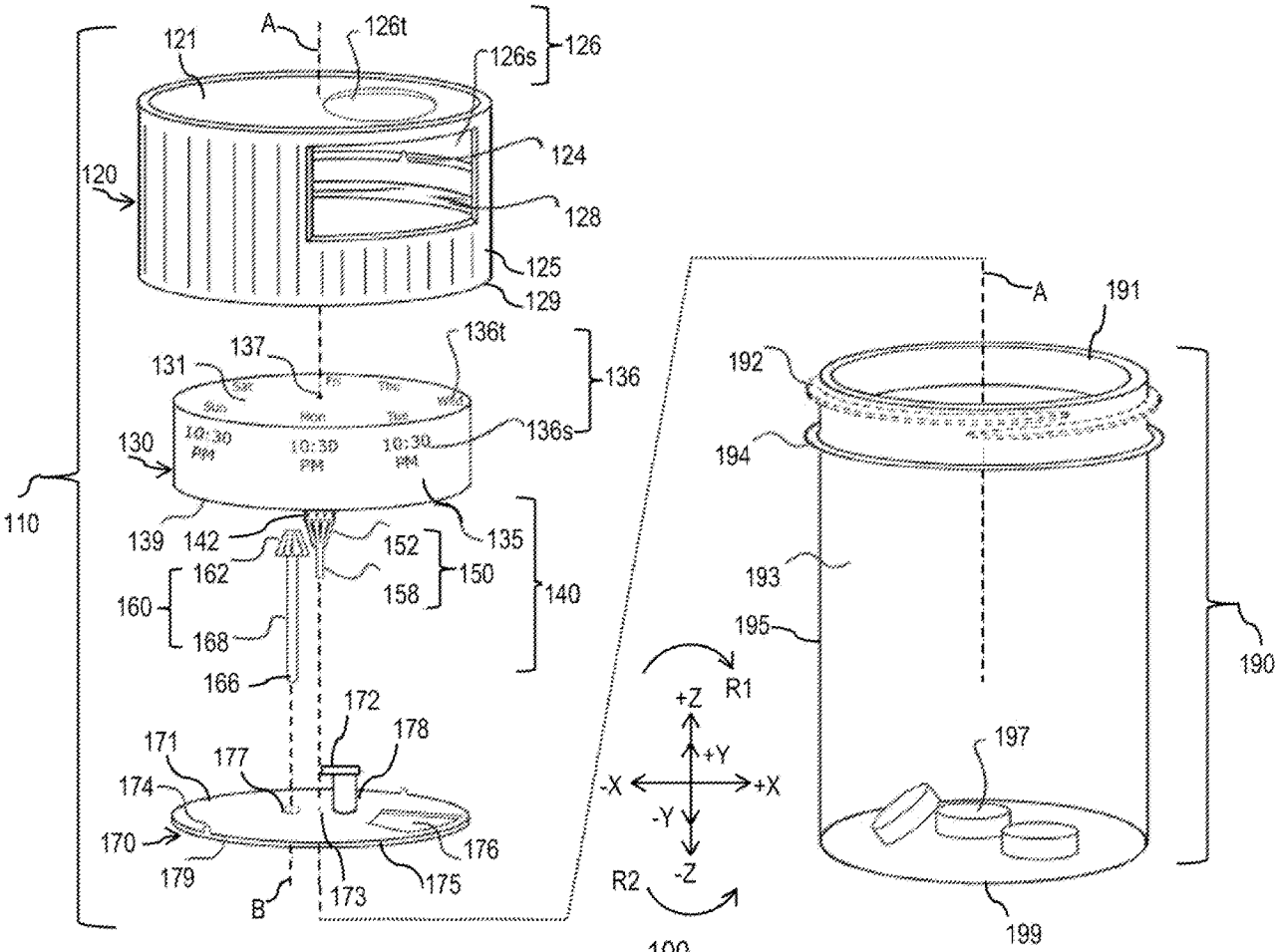
FIG. 1 is an exploded perspective view of an embodiment of a container assembly.

This disclosure relates to adjustable indicators for container assemblies and, more particularly, to adjustable indicators for closures of medicine bottle containers that keep track of medication schedules, as well as methods for using and making the same. A gear assembly may be provided with a cap of a container assembly. The gear assembly may be operative to translate motion (e.g., rotation) of a user handle into motion (e.g., rotation) of a dial for changing the portion of indicia of the dial that may be aligned with a passageway through the cap. The dial, indicia, and at least a portion of the gear assembly may be positioned within a secure indicia space defined by components of the cap, while the user handle may be positioned at least partially outside of that secure space, such that the secure space may prevent inadvertent or undesired movement of the dial unless dictated by the user handle. In some embodiments, two distinct motions may be applied to the user handle before the gear assembly may translate motion of the user handle into motion of the dial. For example, the user handle may be configured to push a user gear of the gear assembly towards a dial gear of the gear assembly, such that teeth of the user gear may mesh with teeth of the dial gear. Then, once the teeth are meshed, the user handle may be configured to rotate the user gear about a first axis, which may rotate the dial gear about a second axis for moving the dial, which may be coupled to the dial gear. The first axis may be the same as or different than the second axis. The gear assembly may provide a stopper mechanism that may prevent opposite rotation of either the user gear or the dial gear, such that the dial may only be moved in one direction with respect to the cap.

FIGS. 1-6 (Assembly 100)

FIGS. 1-6 show an illustrative bottle container assembly 100 with an adjustable indicator that may be used for any suitable purpose, such as for keeping track of a schedule with respect to any suitable content 197 (e.g., medicine) that may be held by assembly 100. As shown, assembly 100 may include a bottle 190 and a cap or cap subassembly 110 that may be coupled to bottle 190 for forming a closed container that may safely hold content 197 therein. For example, bottle 190 may include a bottle body that may include one or more side walls 195 that may extend from a closed bottom end 199 to an at least partially open top end 191 for defining an interior bottle space 193. Bottle 190 may be configured such that a user may insert content 197 through open end 191 into bottle space 193 (e.g., along the −Z direction) and/or may remove content 197 from bottle space 193 through open end 191 (e.g., along the +Z direction). Bottle 190 may be any suitable container portion that may be configured to hold any suitable content 197 in any suitable way. Bottle 190 may be made of any suitable material or combination of materials and may be of any suitable dimensions. For example, although bottle 190 may be shown to define a cylindrically shaped bottle space 193 and a circular opening 191, any suitable shapes of any suitable sizes may be provided by any suitable portions of bottle 190.

Cap subassembly 110 may be configured to be removably coupled to bottle 190, such that cap subassembly 110 may cover open end 191 for preventing a user from accessing bottle space 193 (e.g., content 197) when cap subassembly 110 is coupled to bottle 190, and such that cap subassembly 110 may not cover at least a portion of open end 191 for enabling a user to access bottle space 193 (e.g., content 197) when cap subassembly 110 is not coupled to bottle 190. Assembly 100 may be configured in any suitable way for enabling cap subassembly to be removably coupled to bottle 190. As just one example, as shown in FIGS. 1-6, bottle 190 may include at least one cap attachment feature 192 (e.g., one or more male threads protruding from an exterior surface of body 195 adjacent end 191) and cap subassembly 110 may include at least one bottle attachment feature 128 (e.g., one or more female threads protruding from an interior surface of cap subassembly 110), where bottle attachment feature 128 may be screwed or otherwise rotated down around cap attachment feature 192 (e.g., downwardly in the −Z direction about the Z-axis in the direction of arrow R1) for securing cap subassembly 110 to bottle 190 over open end 191 (see, e.g., FIGS. 2 and 6). In some such embodiments, as shown, bottle attachment feature 128 may be configured to rotate with respect to cap attachment feature 192 about a longitudinal axis A for enabling cap subassembly 110 and bottle 190 to be removably coupled to one another (e.g., in the direction of arrow R1 for coupling and in the direction of arrow R2 for removing). It is to be understood that while arrow R1 may be shown as a clockwise type rotation direction about the Z-axis (e.g., axis A) and that while arrow R2 may be shown as a counterclockwise type rotation direction about the Z-axis (e.g., axis A), these associations may be flipped or may be any other suitable opposing rotation directions or any other suitable translation directions. In such threaded embodiments, cap attachment feature 192 and bottle attachment feature 128 may provide a safety child-resistant mechanism (e.g., where cap subassembly 110 may be pushed downwardly in order to enable twisting or rotating for removing cap subassembly 110 from bottle 190). Cap attachment feature 192 and bottle attachment feature 128 may be any suitable combination of reciprocal or otherwise related features that may be configured to interact with each other for removably coupling cap subassembly 110 to bottle 190 (e.g., snaps, notches, clips, location or transition fits, etc.). Bottle 190 may also include a lip 194, which may protrude from an exterior surface of body 195 below cap attachment feature 192, where lip 194 may be configured to suspend cap subassembly 110 by at least a certain distance above closed end 199. Cap attachment feature 192 and/or lip 194 may ensure a specific relationship between cap subassembly 110 and bottle 190 when cap subassembly 110 is coupled to bottle 190.

Cap subassembly 110 may include an adjustable indicator that may be utilized for any suitable purpose, such as for keeping track of a schedule with respect to any suitable content 197. As shown in FIGS. 1-6, for example, cap subassembly 110 may include a closure 120, a dial 130, a gear assembly 140, and a base 170. Closure 120 of cap 110 may include a closure body that may include one or more side walls 125 that may extend from an at least partially closed top end 121 to an at least partially open bottom end 129 for defining an interior closure space 123. Bottle attachment feature 128 may be provided along an interior surface of a side wall 125 adjacent or otherwise near end 129, or at any other suitable position of closure 120 (e.g., bottle attachment feature 128 may be provided on an external surface of closure 120 or along bottom end 129). Closure 120 may be configured to be removably coupled to bottle 190 for at least partially preventing content 197 from being removed from bottle space 197 and/or for maintaining the freshness of content 197. Closure 120 may also include one or more closure indicia passageways 126 through any suitable portions of closure 120 for selectively exposing to a user one or more other portions of cap subassembly 100 (e.g., portions of dial 130, as described below). As shown, closure indicia passageways 126 may include at least one top closure indicia passageway **126*t* that may be provided through the wall of top end 121 of closure 120, at least one side closure indicia passageway 126*s* that may be provided through one or more side walls 125 of closure 120, and/or at least one bottom closure indicia passageway (e.g., passageway 176 as described below with respect to base 170). As described below, each closure indicia passageway 126 may be a hollow opening through a wall or other portion of closure 120 or may be such an opening that may be covered by or otherwise configured to include a transparent or translucent material or any other suitable object (e.g., a magnifying glass 126*tm*, 126*sm*, etc.) that may enable communication of information therethrough to a user of assembly 100. Such an object positioned within an indicia passageway may be configured to prevent a user or other entity external to assembly 100 from interacting with dial 130 through that indicia passageway (e.g., such that dial 130 may not be moved within indicia spacing 183 except via interaction with gear assembly 140). Closure 120 may be made of any suitable material or combination of materials and may be of any suitable dimensions. For example, although closure 120 may be shown to define a cylindrically shaped closure space 123 and a circular opening 129, any suitable shapes of any suitable sizes may be provided by any suitable portions of closure 120. In some embodiments, closure 120 may be configured to define a majority of the external appearance of cap subassembly 110 (e.g., at least a majority of the external appearance of the top and sides of cap subassembly 110**).

Dial 130 of cap 110 may include a dial body that may include one or more side walls 135 that may extend from an at least partially closed top end 131 to an at least partially closed bottom end 139. Dial 130 may include any suitable dial indicia 136 on any suitable portions of dial 130 for selective display to a user of assembly 100 (as described below). Dial indicia 136 may be stamped on dial 130, provided by a sticker adhered to dial 130, painted on dial 130 (e.g., with glow in the dark paint), etched into dial 130, and/or provided via any other suitable method. As shown, dial indicia 136 may include top dial indicia 136*t* that may be provided on an exterior surface of top end 131 of dial 130, side dial indicia 136*s* that may be provided on an exterior surface of one or more side walls 135 of dial 130, and/or bottom dial indicia 136*b* that may be provided on an exterior surface of bottom end 139 of dial 130. Dial 130 may be configured to fit at least partially within closure space 123, such that dial 130 may be moved within closure space 123 with respect to closure 120 for selectively aligning different dial indicia 136 of dial 130 with a closure indicia passageway 126 of closure 120. Dial 130 may be made of any suitable material or combination of materials and may be of any suitable dimensions. For example, although dial 130 may be shown to define a cylindrically shaped object with a circular top wall 131 and a circular bottom wall 139, any suitable shapes of any suitable sizes may be provided by any suitable portions of dial 130.

Base 170 of cap 110 may include a base body that may include one or more side walls 175 that may extend from an at least partially closed top end 171 to an at least partially closed bottom end 179. Base 170 may be configured to be coupled (e.g., permanently or removably) to closure 120, such that, for example, base 170 and closure 120 may together define at least a portion of an indicia space 183 within which dial 130 may be positioned. For example, as shown in FIGS. 1-6, base 170 may include at least one closure attachment feature 174 (e.g., one or more notches protruding from an exterior surface of base 170) and closure 120 may include at least one base attachment feature 124 (e.g., one or more grooves or female threads protruding from an interior surface of closure 120), where closure attachment feature 174 may snap into or otherwise fit base 170 within base attachment feature 124 for securing base 170 within closure space 123, which may thereby define a reduced indicia space 183 between closure 120 and base 170 (see, e.g., FIG. 6). In some such embodiments, as shown, base 170 may be pushed upwardly (e.g., in the +Z direction) for interlocking with base attachment feature 124 of closure 120. Base attachment feature 124 may be positioned above bottle attachment feature 128 within closure space 123 of closure 120 such that base 170 may be coupled to closure 120 while still enabling bottle attachment feature 128 to removably couple closure 120 to bottle 190. While closure space 123 may be defined by the interior surface(s) of side wall(s) 125, top end 121, and bottom end 129 of closure 120, indicia space 183 may be defined by the interior surface(s) of side wall(s) 125 and top end 121 of closure 120 as well as by base 170, such that indicia space 183 may be a portion of closure space 123. Thus, base 170 may be configured to fit at least partially within closure space 123, such that base 170 may define at least a portion of the bottom of indicia space 183. As shown and as described below, base 170 may also include a base indicia passageway 176 that may be provided through the base body from top end 171 to bottom end 179, where such base indicia passageway 176 may also be referred to herein as a bottom closure indicia passageway, as base 170 may act as a bottom of indicia space 183 defined by closure 120 at its top and sides. As described below, like each closure indicia passageway 126, base indicia passageway 176 may be a hollow opening through a wall or other portion of base 170 or may be such an opening that may be covered by or otherwise configured to include a transparent or translucent material or any other suitable object (e.g., a magnifying glass 176*m*) that may enable communication of information therethrough to a user of assembly 100. Such an object positioned within base indicia passageway 176 may be configured to prevent a user or other entity external to indicia space 183 from interacting with dial 130 through base indicia passageway 176 (e.g., such that dial 130 may not be moved within indicia spacing 183 except via interaction with gear assembly 140). Base 170 may be made of any suitable material or combination of materials and may be of any suitable dimensions. For example, although base 170 may be shown to define a disc or cylindrically shaped object with a circular top wall 171 and a circular bottom wall 179, any suitable shapes of any suitable sizes may be provided by any suitable portions of base 170. Base 170 may be a single molded piece to provide the entire structure of base 170, which may or may not include component 172 described below. Dial 130 may be positioned within indicia space 183 when base 170 is coupled to closure 120 (see, e.g., FIG. 6).

Gear assembly 140 of cap 110 may be at least partially positioned within indicia space 183 along with dial 130, and gear assembly 140 may be configured to selectively move dial 130 within indicia space 183 with respect to closure 120 for selectively aligning different dial indicia 136 with a closure indicia passageway 126 of closure 120. Gear assembly 140 may include one or more gears that may be configured to translate a user motion that may be applied to a first portion of gear assembly 140 into movement of dial 130 with indicia space 183 (e.g., rotation of dial 130 about an axis A along a Z-axis). As shown in FIGS. 1-6, for example, gear assembly 140 may include an upper or dial gear subassembly 150 and a lower or user gear subassembly 160. Dial gear subassembly 150 may include an upper or dial cogwheel or gear 152 and, in some embodiments, an upper or dial gear shaft 158 that may extend away from gear 152 along an axis of rotation of gear 152 (e.g., axis A along a Z-axis). Gear shaft 158 and gear 152 may be a single molded piece or may be distinct elements coupled via any suitable coupling features (e.g., glue, threading, etc.). User gear subassembly 160 may include a lower or user cogwheel or gear 162 and, in some embodiments, a lower or user gear shaft 168 that may extend away from gear 162 along an axis of rotation of gear 162 (e.g., axis B along a Z-axis that may be parallel to axis A). Gear shaft 168 and gear 162 may be a single molded piece or may be distinct elements coupled via any suitable coupling features (e.g., glue, threading, etc.). User gear subassembly 160 may also include a user handle 166 that may be coupled to a portion of gear 162 (e.g., at an end of gear shaft 168), such that a user may apply a user force or motion to handle 166 for rotating gear 162. Gear shaft 168 and handle 166 may be a single molded piece or may be distinct elements coupled via any suitable coupling features (e.g., glue, threading, hinge, etc.). Gear assembly 140 may be configured to translate movement (e.g., rotation) of gear 162 into movement (e.g., rotation) of gear 152, which may be configured to move (e.g., rotate) dial 130 with respect to closure 120 within indicia space 183. For example, as shown, gear 162 may include teeth or cogs or any other suitable mechanical feature that may mesh with teeth or cogs or any other suitable mechanical feature of gear 152 to transmit torque therebetween within gear assembly 140 (e.g., as a transmission or gearbox).

Base 170 may be configured to support at least a portion of gear assembly 140 and/or dial 130 within indicia space 183 when base 170 is coupled to closure 120. For example, as shown, at least a portion of user gear subassembly 160 (e.g., a bottom portion of gear 162) may be configured to rest against base 170 (e.g., against an exterior surface of top wall 171 of base 170). A user gear shaft opening 177 may be provided through base 170 (e.g., between top wall 171 and bottom wall 179) for enabling at least a portion of user gear shaft 168 and/or user handle 166 to extend therethrough from indicia space 183 to at least a portion of closure space 123 and/or bottle space 193 or for at least enabling a portion of gear subassembly 160 to be accessible therethrough, such that a portion of gear assembly 140 may be accessible to a user when cap 110 is not coupled to bottle 190 (e.g., when a user unscrews cap 110 from bottle 190 for accessing contents 197). Such accessibility to a portion of gear subassembly 160 by a user external to indicia space 183 (e.g., via user gear shaft opening 177 of base 170) may enable a user of assembly 100 to apply a user force or motion to handle 166 for rotating gear 162. Alternatively or additionally, in some embodiments, user gear shaft opening 177 of base 170 may at least partially define an axis of rotation of user gear 162 and/or may otherwise limit at least a portion of a path along which at least a portion of user gear subassembly 160 may travel (e.g., by preventing or limiting movement of gear subassembly 160 along the X-axis and/or along the Y-axis within indicia space 183). For example, as shown, user gear 162 may be configured to rotate about an axis B, and gear shaft 168 may extend away from gear 162 along axis B, such that gear shaft opening 177 may align with axis B. Additionally or alternatively, as shown, at least a portion of dial gear subassembly 150 (e.g., a top portion of gear 152) may be coupled to dial 130 (e.g., non-rotatably affixed (e.g., via an adhesive or a bolt) to an exterior surface of bottom wall 139 of dial 130), such that movement of gear subassembly 150 may provide movement of dial 130 (e.g., rotational movement about axis A). In some embodiments, a dial gear shaft opening 173 may be provided through at least a portion of base 170 (e.g., through top wall 171), where opening 173 may at least partially define an axis of rotation of dial gear 152 and/or may otherwise limit at least a portion of a path along which at least a portion of dial gear subassembly 150 may travel (e.g., by preventing or limiting movement of gear subassembly 150 along the X-axis and/or along the Y-axis within indicia space 183). For example, as shown, dial gear 152 may be configured to rotate about an axis A, and gear shaft 158 may extend away from gear 152 along axis A, such that gear shaft opening 173 may align with axis A. However, in some embodiments, gear shaft opening 173 and/or gear shaft 158 may not be necessary and other features of assembly 100 may define axis A about which gear 152 may rotate. For example, the positioning of base 170, gear subassembly 160, and dial 130 within indicia space 183 may limit the manner in which gear subassembly 150 may move within indicia space 183 (e.g., only to movement about axis A). In some embodiments, as shown in FIGS. 1-6, an interior surface of top end 121 of closure 120 may include a dial movement feature 127 and an exterior surface of top end 131 of dial 130 may include a closure movement feature 137, where such features 127 and 137 may interact with one another to at least partially define an axis of rotation of dial 130 with respect to closure 120 (e.g., axis A) or otherwise aid or limit such movement (e.g., by preventing or limiting movement of dial 130 along the X-axis and/or along the Y-axis within indicia space 183), for example, where feature 137 may be a nub that may extend into a cut out or notch 127. In some embodiments, the thickness of dial 130 along the Z-axis combined with the thickness of gear assembly 140 along the Z-axis may be substantially equal to or slightly less than the thickness of indicia space 183 along the Z-axis, such that dial 130 and/or gear assembly 140 may be prevented or limited with respect to movement along the Z-axis.

Figure 2:
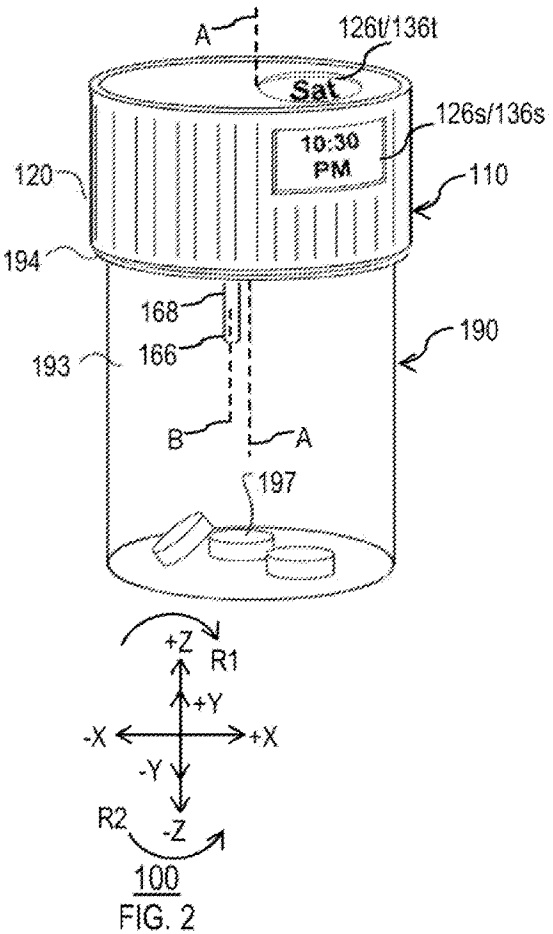
FIG. 2 is a non-exploded perspective view of the container assembly of FIG. 1.
Figure 3:
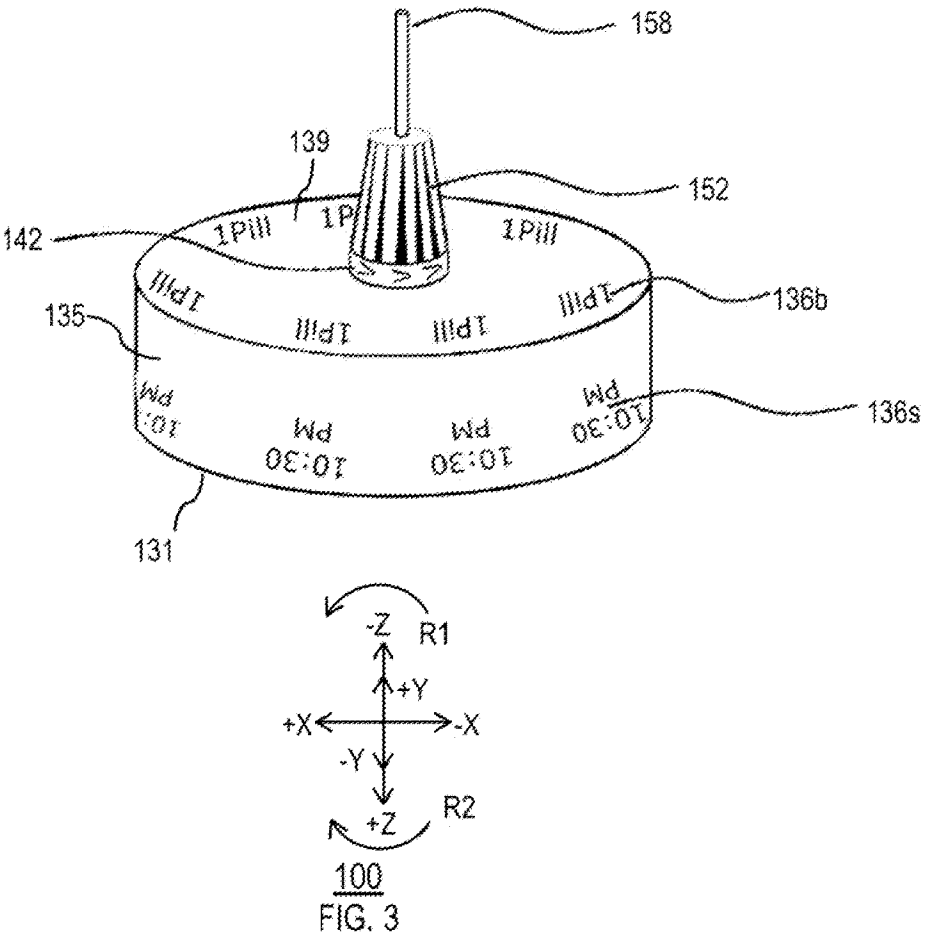
FIG. 3 is a perspective view of a portion of the container assembly of FIGS. 1 and 2.

As just one example of use, a user may interact with handle 166 of user gear subassembly 160, as may be accessible to a user through opening 177 of base 170, for rotating gear shaft 168 and/or gear 162 in the direction of arrow R2 about axis B, which may in turn rotate gear 152 of dial subassembly 150 in the direction of arrow R1 about axis A, which may in turn rotate dial 130 in the direction of arrow R1 about axis A. Such rotation of dial 130 in the direction of arrow R1 about axis A within indicia space 183 with respect to closure 120 may alter the particular portion of dial 130 and, thus, the particular portion of dial indicia 136 that may be aligned with a particular closure indicia passageway 126, which may alter what information may be provided to a user of assembly 100 by that particular portion of dial indicia 136. For example, as shown in FIGS. 1-6, top dial indicia **136*t* may include seven distinct indications or marks respectively indicative of one of the seven days of the calendar week, while side dial indicia 136*s* may include seven distinct indications or marks, each of which may be adjacent a respective one of the indications of top dial indicia 136*t* and may be indicative of a particular time of day, and while bottom dial indicia 136*b* may include seven distinct indications or marks, each of which may be adjacent a respective one of the indications of side dial indicia 136*s* and may be indicative of a particular dosage (e.g., number of pills of content 197). In such embodiments, a particular set of adjacent indications including one from each of dial indicia 136*t*, 136*s*, and 136*b* may be aligned with a set of respective adjacent passageways of indicia space 183 including indicia passageways 126*t*, 126*s*, and 176, such that assembly 100 may be configured to expose a particular day of the week, a particular time of day, and a particular dosage to a user of assembly 100 via cap subassembly 110. For example, as shown in FIG. 2, when dial 130 is at a first particular orientation with respect to closure 120 and base 170 within indicia space 183, a first day of the week indication "Sat." of top dial indicia 136*t* may be aligned with and visible through indicia passageway 126*t*, and a first time of day indication "10:30 PM" of side dial indicia 136*s* may be aligned with and visible through indicia passageway 126*s*, and a first dosage indication "1 Pill" of bottom dial indicia 136*b* may be aligned with and visible through indicia passageway 176 (see, e.g., the orientation of FIG. 6, which may only be visible to a user of assembly 100 when cap 110 is removed from bottle 190). However, when dial 130 is rotated in the direction of arrow R1 about axis A within indicia space 183 with respect to closure 120 from such a first orientation to a second orientation, the particular portion of dial 130 and, thus, the particular portion of dial indicia 136 that may be aligned with such indicia passageways 126/176 may be altered, for example, such that a second day of the week indication "Sun." of top dial indicia 136***t* may be aligned with and visible through indicia passageway 126*t*, a second time of day indication "10:30 PM" of side dial indicia 136*s* may be aligned with and visible through indicia passageway 126*s*, and a second dosage indication "1 Pill" of bottom dial indicia 136*b* may be aligned with and visible through indicia passageway 176. This may enable a user of assembly 100 to update the information communicated to the user by dial 130 through cap subassembly 110 daily after the user takes the appropriate content 197 of bottle 190 for that day so that the user will be reminded on the appropriate dosage for the following day. It is to be understood that any other or any additional suitable information may be described by any one or more of the various dial indicia groupings 136*t*, 136*b*, and 136*s*. Moreover, it is to be understood that two or more passageways 126/176 of cap subassembly 110 may be positioned in any suitable arrangement about cap subassembly 110 and need not be provided at least partially within a single plane (e.g., the X-Z plane of FIG. 6), which would thereby allow two or more dial indications 136 to be exposed that are not adjacent one another (e.g., not at least partially within a single plane).

Figure 4:
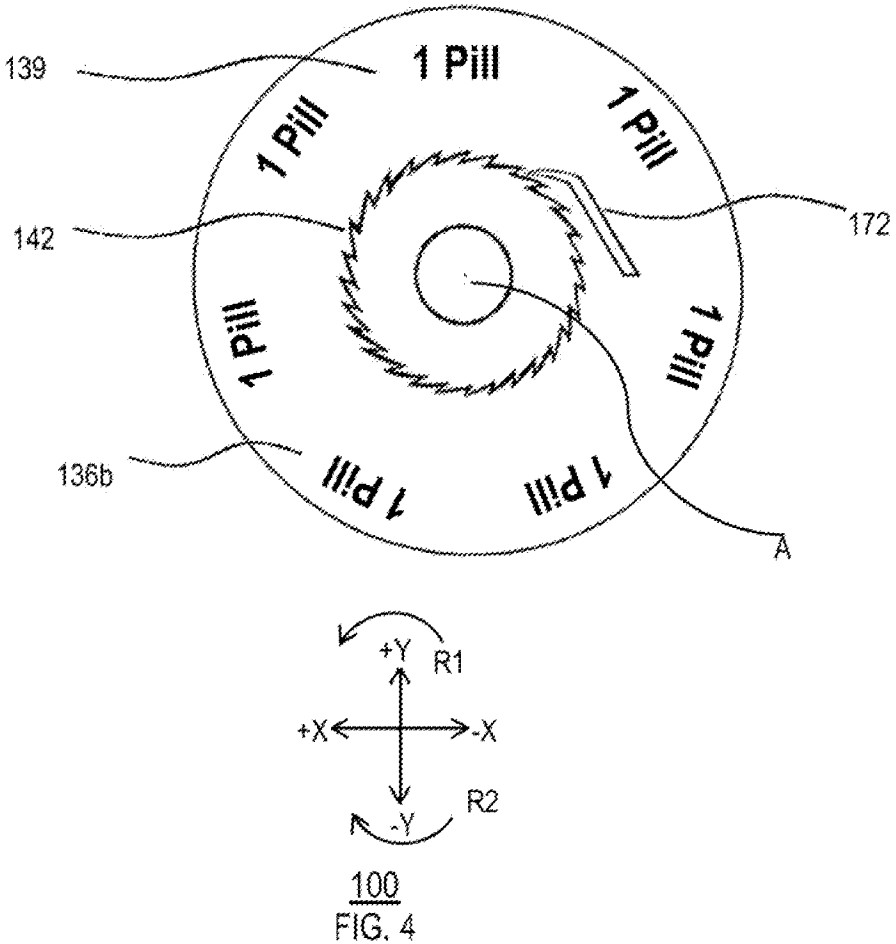
FIG. 4 is a view of a portion of the container assembly of FIGS. 1-3, taken from line IV-IV of FIG. 6.
Figure 5:
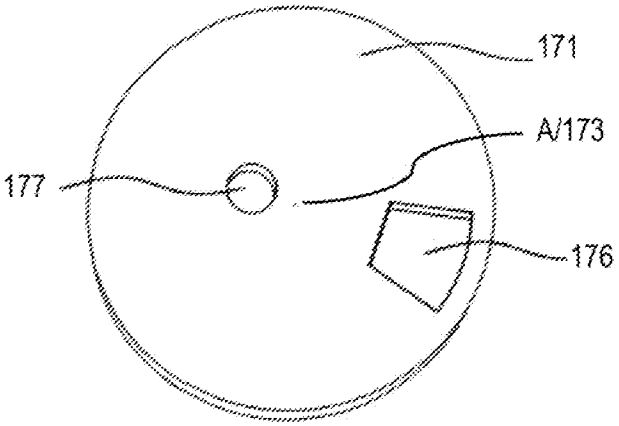
FIG. 5 is a perspective view of a portion of the container assembly of FIGS. 1-4.
Figure 5:
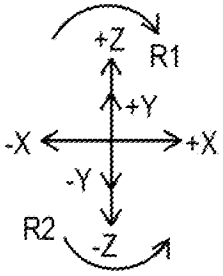
Figure 6:
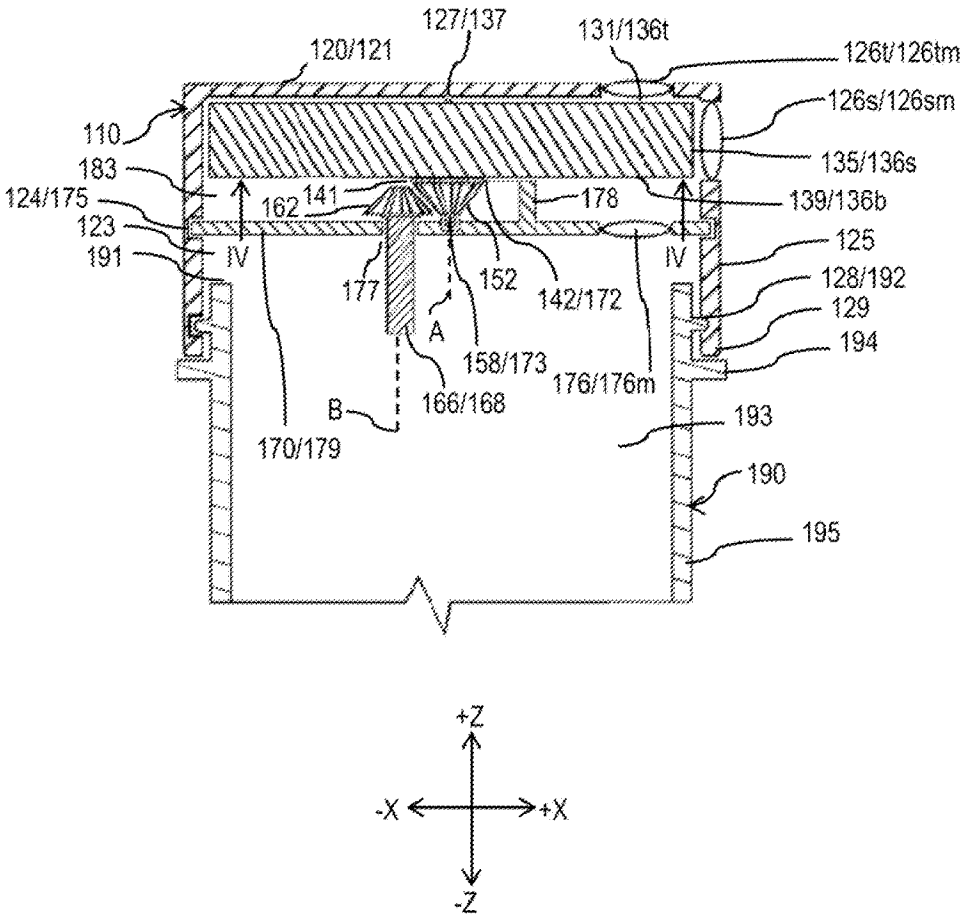
FIG. 6 is a cross-sectional view of a portion of the container assembly of FIGS. 1-5.

While cap subassembly 110 may be configured to enable rotation of dial 130 in the direction of arrow R1 about axis A within indicia space 183 with respect to closure 120 from a first orientation to a second orientation (e.g., to keep track of a medication schedule for content 197 of bottle 190) by enabling user rotation of handle 166 in the direction of arrow R2 about axis B, cap subassembly 110 may be configured to prevent rotation of dial 130 in the opposite direction of arrow R2 about axis A. For example, as shown, gear assembly 140 may include a ratchet component 142 with ratcheting teeth/notches or other suitable features and base 170 may include a stopper component 172 with a tensioned free end that may be configured to interact with ratchet component 142 for preventing rotation of gear subassembly 150 and, thus, dial 130 in the direction of arrow R2 while enabling rotation of gear subassembly 150 in the direction of arrow R1. Ratchet component 142 may be provided anywhere along any portion of gear assembly 140 and base 170 may be configured to provide stopper component 172 at any suitable position with indicia space 183 that may enable proper interaction between components 142 and 172. For example, as shown in FIGS. 4 and 6, ratchet component 142 may be provided along a portion of gear subassembly 150 (e.g., adjacent a top portion of gear 152 at or near dial 130) and base 170 may provide stopper component 172 just adjacent ratchet component 142 in the +X direction (e.g., at the top end of an extension body 178 that may extend from a top surface of the base body of base 170), such that a free end of stopper component 172 may enable rotation of ratchet component 142 and, thus, gear 152 and dial 130 in the direction of arrow R1 about axis A and at the same time prevent rotation of ratchet component 142 and, thus, gear 152 and dial 130 in the direction of arrow R2 about axis A (e.g., due to the geometrical relationship between teeth or other suitable features of ratchet component 142 and the free end of stopper component 172). This may prevent a user from rotating gear assembly 140 in the wrong direction (e.g., by an intentional user force but in an incorrect direction). Moreover, interaction of ratchet component 142 and stopper component 172 may emit a sound that may be audible to a user (e.g., a clicking sound) each time ratchet component 142 is rotated or advanced with respect to stopper component 172, which may provide a user with an audible feedback to user adjustment of the indicia of assembly 100. Additionally or alternatively, interaction of ratchet component 142 and stopper component 172 may generate a tactile resistance and then release that may be felt by a user each time ratchet component 142 is rotated or advanced with respect to stopper component 172, which may provide a user with a tactile or haptic feedback to user adjustment of the indicia of assembly 100. In some embodiments, stopper component 172 may be tensioned by a suitable amount such that the free end of stopper component 172 may exert a suitable force on ratchet component 142 for even preventing rotation of dial 130 in the direction of arrow R1 about axis A, where such a force may be overcome by an intentional user force on handle 166 but that may not be overcome by any unintentional forces to which cap subassembly 110 may be susceptible during normal use of assembly 100, such that components 142/172 may enable proper rotation of dial 130 in the direction of arrow R1 but only if at least a certain amount of threshold force is applied to gear assembly 140 (e.g., to handle 166).

Additionally or alternatively to being provided with ratchet component and stopper component (e.g., ratchet component 142 and stopper component 172), gear assembly 140 may be configured to have a resting state in which movement of gear subassembly 150 may not translate into motion of gear subassembly 160 (and vice versa) and an active state in which movement of gear subassembly 150 may translate into motion of gear subassembly 160 (and vice versa). For example, as shown in FIG. 6, gear assembly 140 may be in a resting state, whereby a spacing distance 141 may exist between gear 152 and gear 162 (e.g., along the X-axis and/or along the Z-axis of FIG. 6), such that any rotation of user gear 162 in such a resting state (e.g., about axis B in the direction of arrow R1 or arrow R2) would not be translated into a rotation of dial gear 152. In order to reconfigure gear assembly 140 from such a resting state into an active state, a user may first apply an upward force (e.g., longitudinal force in the +Z direction along axis B) on gear subassembly 160 (e.g., via handle 166, such as along a longitudinal axis of gear shaft 168), such that gear 162 may be moved upwards by spacing distance 141 in order to contact gear 152 (e.g., such that teeth of gear 162 may mesh with teeth of gear 152), and then the user may apply a rotation force (e.g., in the direction of arrow R2 about axis B) to user gear subassembly 160 (e.g., via handle 166) for rotating meshed dial gear 152 in the direction of arrow R1 about axis A. Therefore, like a safety or child-resistant mechanism may be provided by bottle attachment feature 128 and cap attachment feature 192 that may require cap subassembly 110 be pushed downwardly in order to enable twisting or rotating for removing cap subassembly 110 from bottle 190, gear assembly 140 may provide a safety or child-resistant mechanism that may require user gear subassembly 160 be pushed towards dial gear subassembly 150 in order to enable effective rotation of user gear subassembly 160 for translating dial gear subassembly 150 (e.g., for updating exposed dial indicia 136). This may help prevent unintentional rotation of dial 130 and, thus, unintentional updating of exposed dial indicia 136. Spacing distance 141 may be any suitable distance for any suitable assembly of any suitable use case, such as 0.125 inches (e.g., along the Z-axis) for a pill bottle container.

By preventing inadvertent or undesired movement of dial 130 within indicia space 183 through use of ratchet/stopper components 142/172 and/or use of spacing distance 141, and/or by preventing user access to dial 130 and gear assembly 140 externally to assembly 100, but instead by limiting user access to dial 130 via gear assembly 140 when cap 110 has been removed from bottle 190, assembly 100 may provide a reliable and easy to use indicator mechanism (e.g., for tracking a medication schedule). By providing at least three distinct sets of dial indicia (e.g., indicia 136*t*, 136*s*, and 136*b*) via respective passageways to a user, various amounts of helpful information may be simultaneously communicated to a user for managing the content of assembly 100. Although, it is to be understood, that only one or two of such indicia may be provided in other embodiments. In yet other embodiments, more than three of such indicia may be provided (e.g., two distinct sets of indicia may be provided along different heights of a side wall 135 of dial 130 (e.g., a second set of side dial indicia may be provided above or below side dial indicia 136*s* while a second distinct side closure indicia passageway may be provided above or below side closure indicia passageway 126*s*). It is to be understood that, in some embodiments, as shown, at least a portion of side wall 135 of dial 130 and/or at least a portion of side wall 125 of closure 120 may extend (e.g., in a Y-Z plane) parallel to the axis of rotation of dial 130 within closure 120 (e.g., axis A along an axis Z), while at least a portion of top 131 of dial 130 and/or at least a portion of top 121 of closure 120 may extend (e.g., in an X-Y plane) perpendicularly to the axis of rotation of dial 130 within closure 120 (e.g., axis A along an axis Z), and while at least a portion of bottom 139 of dial 130 and/or at least a portion of bottom 179 of base 170 may extend (e.g., in an X-Y plane) perpendicularly to the axis of rotation of dial 130 within closure 120 (e.g., axis A along an axis Z).

Figure 7:
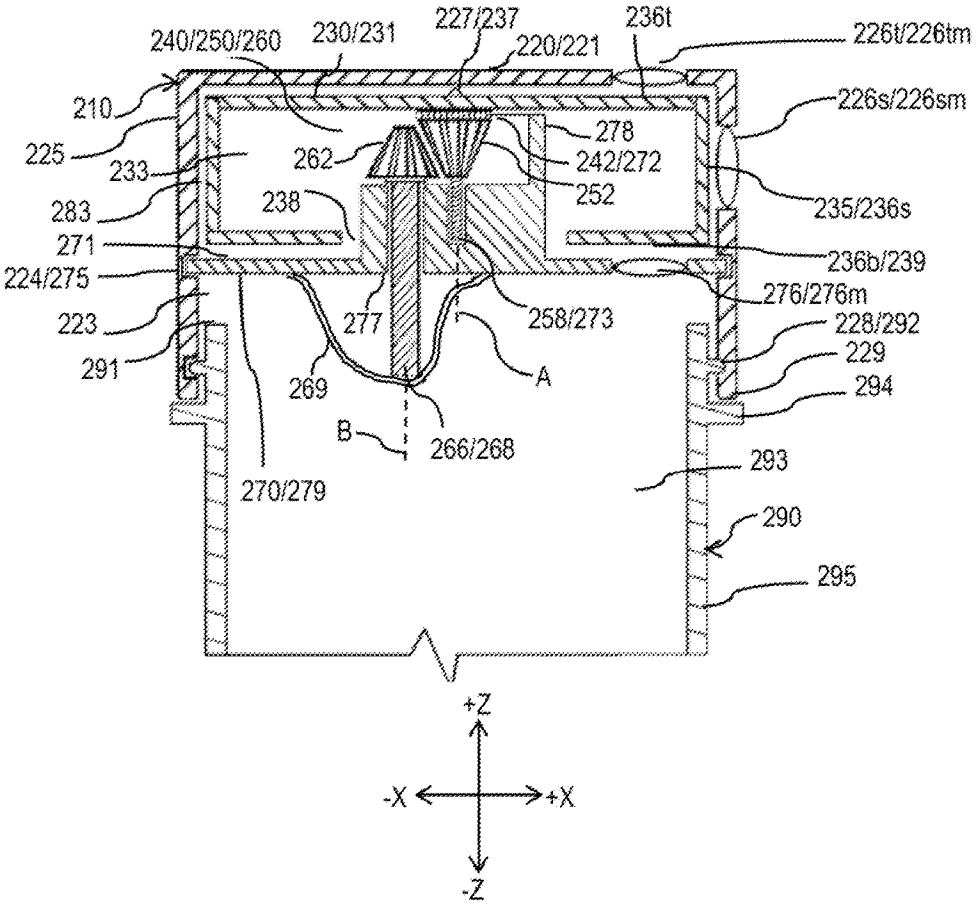
FIG. 7 is a cross-sectional view, similar to FIG. 6, of a portion of another embodiment of a container assembly.

FIG. 7 (Assembly 200)

FIG. 7 shows another illustrative bottle container assembly 200, which may be similar to assembly 100 of FIGS. 1-6 but may include a hollow dial within which at least a portion of a gear assembly may reside. Assembly 200 of FIG. 7 may include similar components to assembly 100 of FIGS. 1-6, with components of assembly 200 of FIG. 7 being labeled with "2xx" reference labels that may correspond to the "1xx" reference labels of the labeled components of assembly 100 of FIGS. 1-6, where differences therebetween may be described below. As shown, assembly 200 may include a bottle 290 and a cap 210 that may be coupled to bottle 290 for forming a closed container that may safely hold content therein. For example, bottle 290 may include a bottle body that may include one or more side walls 295 that may extend from a closed bottom end (not shown) to an at least partially open top end 291 for defining an interior bottle space 293. Bottle 290 may be configured such that a user may insert content (not shown) through open end 291 into bottle space 293 (e.g., along the −Z direction) and/or may remove content from bottle space 293 through open end 291 (e.g., along the +Z direction). Bottle 290 may be any suitable container portion that may be configured to hold any suitable content in any suitable way. Bottle 290 may be made of any suitable material or combination of materials and may be of any suitable dimensions.

Cap 210 may be configured to be removably coupled to bottle 290, such that cap 210 may cover open end 291 for preventing a user from accessing bottle space 293 when cap 210 is coupled to bottle 290, and such that cap 210 may not cover at least a portion of open end 291 for enabling a user to access bottle space 293 when cap 210 is not coupled to bottle 290. Assembly 200 may be configured in any suitable way for enabling cap subassembly to be removably coupled to bottle 290. As just one example, bottle 290 may include at least one cap attachment feature 292 and cap 210 may include at least one bottle attachment feature 228, where cap attachment feature 292 and bottle attachment feature 228 may be any suitable combination of reciprocal or otherwise related features that may be configured to interact with each other for removably coupling cap 210 to bottle 290 (e.g., threads, snaps, notches, clips, location or transition fits, etc.). Bottle 290 may also include a lip 294, which may protrude from an exterior surface of body 295 below cap attachment feature 292, where lip 294 may be configured to suspend cap subassembly 210 by at least a certain distance above the closed end. Cap attachment feature 292 and/or lip 294 may ensure a specific relationship between cap 210 and bottle 290 when cap 210 is coupled to bottle 290.

Cap 210 may include a closure 220, a dial 230, a gear assembly 240, and a base 270. Closure 220 of cap 210 may include a closure body that may include one or more side walls 225 that may extend from an at least partially closed top end 221 to an at least partially open bottom end 229 for defining an interior closure space 223. Closure 220 may also include one or more closure indicia passageways 226 through any suitable portions of closure 220 for selectively exposing to a user one or more other portions of cap subassembly 200 (e.g., portions of dial 230, as described below). As shown, closure indicia passageways 226 may include at least one top closure indicia passageway 226*t* that may be provided through the wall of top end 221 of closure 220, at least one side closure indicia passageway 226*s* that may be provided through one or more side walls 225 of closure 220, and/or at least one bottom closure indicia passageway (e.g., passageway 276 as described below with respect to base 270). As described below, each closure indicia passageway 226 may be a hollow opening through a wall or other portion of closure 220 or may be such an opening that may be covered by or otherwise configured to include a transparent or translucent material or any other suitable object (e.g., a magnifying glass 226*tm*, 226*sm*, etc.) that may enable communication of information therethrough to a user of assembly 200. Closure 220 may be made of any suitable material or combination of materials and may be of any suitable dimensions.

Dial 230 of cap 210 may include a dial body that may include one or more side walls 235 that may extend from an at least partially closed top end 231 to an at least partially closed bottom end 239. Unlike dial 130, which may be a solid or closed shape, dial 230 may define an interior dial space 233, which may be accessible via a dial opening 238, which may be provided through any suitable portion of the dial body, such as through bottom end 239. Dial 230 may include any suitable dial indicia 236 on any suitable portions of dial 230 for selective display to a user of assembly 200. As shown, dial indicia 236 may include top dial indicia 236*t* that may be provided on an exterior surface of top end 231 of dial 230, side dial indicia 236*s* that may be provided on an exterior surface of one or more side walls 235 of dial 230, and/or bottom dial indicia 236*b* that may be provided on an exterior surface of bottom end 239 of dial 230 (e.g., adjacent opening 238 along the X-axis). Dial 230 may be configured to fit at least partially within closure space 223, such that dial 230 may be moved within closure space 223 with respect to closure 220 for selectively aligning different dial indicia 236 of dial 230 with a closure indicia passageway 226 of closure 220. Dial 230 may be made of any suitable material or combination of materials and may be of any suitable dimensions.

Base 270 of cap 210 may include a base body that may include one or more side walls 275 that may extend from an at least partially closed top end 271 to an at least partially closed bottom end 279. Base 270 may be configured to be coupled (e.g., permanently or removably) to closure 220, such that, for example, base 270 and closure 220 may together define at least a portion of an indicia space 283 within which dial 230 may be positioned. For example, base 270 may include at least one closure attachment feature (e.g., the shape of an exterior surface of side wall(s) 275 of base 270) and closure 220 may include at least one base attachment feature 224 (e.g., one or more grooves or female threads protruding from an interior surface of closure 220), where base 270 may snap into or otherwise fit base 270 within base attachment feature 224 for securing base 270 within closure space 223, which may thereby define a reduced indicia space 283 between closure 220 and base 270. Base attachment feature 224 may be positioned above bottle attachment feature 228 within closure space 223 of closure 220 such that base 270 may be coupled to closure 220 while still enabling bottle attachment feature 228 to removably couple closure 220 to bottle 290. While closure space 223 may be defined by the interior surface(s) of side wall(s) 225, top end 221, and bottom end 229 of closure 220, indicia space 283 may be defined by the interior surface(s) of side wall(s) 225 and top end 221 of closure 220 as well as by base 270, such that indicia space 283 may be a portion of closure space 223. Thus, base 270 may be configured to fit at least partially within closure space 223, such that base 270 may define at least a portion of the bottom of indicia space 283. As shown, base 270 may also include a base indicia passageway 276 that may be provided through the base body from top end 271 to bottom end 279, where such base indicia passageway 276 may also be referred to herein as a bottom closure indicia passageway, as base 270 may act as a bottom of indicia space 283 defined by closure 220 at its top and sides. As described below, like each closure indicia passageway 226, base indicia passageway 276 may be a hollow opening through a wall or other portion of base 270 or may be such an opening that may be covered by or otherwise configured to include a transparent or translucent material or any other suitable object (e.g., a magnifying glass 276*m*) that may enable communication of information therethrough to a user of assembly 200. Base 270 may be made of any suitable material or combination of materials and may be of any suitable dimensions. Dial 230 may be at least partially positioned within indicia space 283 when base 270 is coupled to closure 220. Moreover, as shown, unlike assembly 100, at least a portion of base 270 may be positioned within dial space 233. While a bottom portion (e.g., bottom 279) of base 270 may be substantially flat (e.g., like bottom 179 of base 170), at least a portion of a profile of a top portion (e.g., top 271) of base 270 may vary in height, for example, such that one portion of base 270 may pass up into dial space 233 via dial opening 238 (e.g., for supporting at least a portion of gear assembly 240) while another portion of base 270 may span bottom 239 of dial 230 (e.g., for defining a bottom of indicia space 283).

Gear assembly 240 of cap 210 may be at least partially positioned within indicia space 283 along with dial 230, and gear assembly 240 may be configured to selectively move dial 230 within indicia space 283 with respect to closure 220 for selectively aligning different dial indicia 236 with a closure indicia passageway 226/276 of closure 220/base 270. Moreover, as shown, unlike assembly 100, at least a portion of gear assembly 240 may be positioned within dial space 233. Gear assembly 240 may include one or more gears that may be configured to translate a user motion that may be applied to a first portion of gear assembly 240 into movement of dial 230 with indicia space 283 (e.g., rotation of dial 230 about an axis A along a Z-axis). As shown, gear assembly 240 may include an upper or dial gear subassembly 250 and a lower or user gear subassembly 260. Dial gear subassembly 250 may include an upper or dial cogwheel or gear 252 and, in some embodiments, an upper or dial gear shaft 258 that may extend away from gear 252 along an axis of rotation of gear 252 (e.g., axis A along a Z-axis). User gear subassembly 260 may include a lower or user cogwheel or gear 262 and, in some embodiments, a lower or user gear shaft 268 that may extend away from gear 262 along an axis of rotation of gear 262 (e.g., axis B along a Z-axis that may be parallel to axis A). User gear subassembly 260 may also include a user handle 266 that may be coupled to a portion of gear 262 (e.g., at an end of gear shaft 268), such that a user may apply a user force or motion to handle 266 for rotating gear 262. Gear assembly 240 may be configured such that rotation of gear 262 may be configured to rotate or otherwise translate gear 252, which may be configured to rotate or otherwise translate dial 230 with respect to closure 220 within indicia space 283. For example, as shown, gear 262 may include teeth or cogs or any other suitable mechanical feature that may mesh with teeth or cogs or any other suitable mechanical feature of gear 252 to transmit torque therebetween within gear assembly 240 (e.g., as a transmission or gearbox).

Base 270 may be configured to support at least a portion of gear assembly 240 and/or dial 230 within indicia space 283 when base 270 is coupled to closure 220. For example, as shown, at least a portion of user gear subassembly 260 (e.g., a bottom portion of gear 262) may be configured to rest against base 270 (e.g., against an exterior surface of top wall 271 of base 270). A user gear shaft opening 277 may be provided through base 270 (e.g., between top wall 271 and bottom wall 279) for enabling at least a portion of user gear shaft 268 and/or user handle 266 to extend therethrough from indicia space 283 to at least a portion of closure space 223 and/or bottle space 293 or for at least enabling a portion of gear subassembly 260 to be accessible therethrough, such that a portion of gear assembly 240 may be accessible to a user when cap 210 is not coupled to bottle 290 (e.g., when a user unscrews cap 210 from bottle 290 for accessing contents 297). Such accessibility to a portion of gear subassembly 260 by a user external to indicia space 283 (e.g., via user gear shaft opening 277 of base 270) may enable a user of assembly 200 to apply a user force or motion to handle 266 for rotating gear 262. Alternatively or additionally, in some embodiments, user gear shaft opening 277 of base 270 may at least partially define an axis of rotation of user gear 262 and/or may otherwise limit at least a portion of a path along which at least a portion of user gear subassembly 260 may travel (e.g., by preventing or limiting movement of gear subassembly 260 along the X-axis and/or along the Y-axis within indicia space 283). For example, as shown, user gear 262 may be configured to rotate about an axis B, and gear shaft 268 may extend away from gear 262 along axis B, such that gear shaft opening 277 may align with axis B. Additionally or alternatively, as shown, at least a portion of dial gear subassembly 250 (e.g., a top portion of gear 252) may be coupled to dial 230 (e.g., to an interior surface of top wall 231 of dial 230 within dial space 233), such that movement of gear subassembly 250 may provide movement of dial 230 (e.g., rotational movement about axis A). In some embodiments, a dial gear shaft opening 273 may be provided through at least a portion of base 270 (e.g., through top wall 271), where opening 273 may at least partially define an axis of rotation of dial gear 252 and/or may otherwise limit at least a portion of a path along which at least a portion of dial gear subassembly 250 may travel (e.g., by preventing or limiting movement of gear subassembly 250 along the X-axis and/or along the Y-axis within indicia space 283). For example, as shown, dial gear 252 may be configured to rotate about an axis A, and gear shaft 258 may extend away from gear 252 along axis A, such that gear shaft opening 273 may align with axis A. However, in some embodiments, gear shaft opening 273 and/or gear shaft 258 may not be necessary and other features of assembly 200 may define axis A about which gear 252 may rotate. For example, the positioning of base 270, gear subassembly 260, and dial 230 within indicia space 283 may limit the manner in which gear subassembly 250 may move within indicia space 283 (e.g., only to movement about axis A). In some embodiments, as shown in FIG. 7, an interior surface of top end 221 of closure 220 may include a dial movement feature 227 and an exterior surface of top end 231 of dial 230 may include a closure movement feature 237, where such features 227 and 237 may interact with one another to at least partially define an axis of rotation of dial 230 with respect to closure 220 (e.g., axis A) or otherwise aid or limit such movement (e.g., by preventing or limiting movement of dial 230 along the X-axis and/or along the Y-axis within indicia space 283), for example, where feature 237 may be a nub that may extend into a cut out or notch 227. In some embodiments, the thickness of the wall of top end 231 of dial 230 along the Z-axis combined with the thickness of gear assembly 240 along the Z-axis may be substantially equal to or slightly less than a thickness of indicia space 283 along the Z-axis, such that dial 230 and/or gear assembly 240 may be prevented or limited with respect to movement along the Z-axis.

As just one example of use, a user may interact with handle 266 of user gear subassembly 260, as may be accessible to a user through opening 277 of base 270, for rotating gear shaft 268 and/or gear 262 in the direction of arrow R2 about axis B, which may in turn rotate gear 252 of dial subassembly 250 in the direction of arrow R1 about axis A, which may in turn rotate dial 230 in the direction of arrow R1 about axis A. Such rotation of dial 230 in the direction of arrow R1 about axis A within indicia space 283 with respect to closure 220 may alter the particular portion of dial 230 and, thus, the particular portion of dial indicia 236 that may be aligned with a particular closure indicia passageway 226/276, which may alter what information may be provided to a user of assembly 200 by that particular portion of dial indicia 236. For example, as shown in FIG. 7, when dial 230 is at a first particular orientation with respect to closure 220 and base 270 within indicia space 283, a first indication of top dial indicia 236*t* may be aligned with and visible through indicia passageway 226*t*, a first indication of side dial indicia 236*s* may be aligned with and visible through indicia passageway 226*s*, and a first indication of bottom dial indicia 236*b* may be aligned with and visible through indicia passageway 276 (e.g., visible by a user when cap 210 is removed from bottle 290). However, when dial 230 is rotated in the direction of arrow R1 about axis A within indicia space 283 with respect to closure 220 from such a first orientation to a second orientation, the particular portion of dial 230 and, thus, the particular portion of dial indicia 236 that may be aligned with such indicia passageways 226/276 may be altered. A liquid proof cover 269 may be provided over at least a portion of gear assembly 240. For example, as shown in FIG. 7, any suitable cover 269 may be provided over a portion of the exterior surface of bottom 279 of base 270 (e.g., over opening 277 and any portion of gear assembly 240 that may extend out from opening 277 beyond bottom 279), whereby cover 269 may prevent any liquid or other element that may have a detrimental effect on the functionality of gear assembly 240 from entering into indicia space 283 via opening 277 (e.g., liquid contents of bottle 290). Cover 269 may be any suitable material (e.g., rubber) that may be flexible enough to enable a user to grasp/push/rotate handle 266 or otherwise interact with gear assembly 240 for moving dial 230.

While cap subassembly 210 may be configured to enable rotation of dial 230 in the direction of arrow R1 about axis A within indicia space 283 with respect to closure 220 from a first orientation to a second orientation (e.g., to keep track of a medication schedule for content of bottle 290) by enabling user rotation of handle 266 in the direction of arrow R2 about axis B, cap subassembly 210 may be configured to prevent rotation of dial 230 in the opposite direction of arrow R2 about axis A. For example, as shown, gear assembly 240 may include a ratchet component 242 and base 270 may include a stopper component 272 that may be configured to interact with ratchet component 242 for preventing rotation of gear subassembly 250 and, thus, dial 230 in the direction of arrow R2 while enabling rotation of gear subassembly 250 in the direction of arrow R1. For example, as shown, ratchet component 242 may be provided along a portion of gear subassembly 250 (e.g., adjacent a top portion of gear 252 at or near dial 230) and base 270 may provide stopper component 272 just adjacent ratchet component 242 in the +X direction (e.g., at the top end of an extension body 278 that may extend from a top surface 271 of the base body of base 270), such that a free end of stopper component 272 may enable rotation of ratchet component 242 and, thus, gear 252 and dial 230 in the direction of arrow R1 about axis A and at the same time prevent rotation of ratchet component 242 and, thus, gear 252 and dial 230 in the direction of arrow R2 about axis A (e.g., due to the geometrical relationship between teeth or other suitable features of ratchet component 242 and the free end of stopper component 272). Moreover, interaction of ratchet component 242 and stopper component 272 may provide a user with an audible and/or tactile feedback to user adjustment of the indicia of assembly 200. In some embodiments, stopper component 272 may be tensioned by a suitable amount such that the free end of stopper component 272 may exert a suitable force on ratchet component 242 for even preventing rotation of dial 230 in the direction of arrow R1 about axis A, where such a force may be overcome by an intentional user force on handle 266 but that may not be overcome by any unintentional forces to which cap subassembly 210 may be susceptible during normal use of assembly 200, such that components 242/272 may enable proper rotation of dial 230 in the direction of arrow R1 but only if at least a certain amount of threshold force is applied to gear assembly 240 (e.g., to handle 266).

Additionally or alternatively to being provided with ratchet component and stopper component (e.g., ratchet component 242 and stopper component 272), gear assembly 240 may be configured to have a resting state in which movement of gear subassembly 250 may not translate into motion of gear subassembly 260 (and vice versa) and an active state in which movement of gear subassembly 250 may translate into motion of gear subassembly 260 (and vice versa). For example, as shown in FIG. 7, gear assembly 240 may be in a resting state, whereby a spacing distance (e.g., similar to spacing distance 141) may exist between gear 252 and gear 262 (e.g., along the X-axis and/or along the Z-axis of FIG. 7), such that any rotation of user gear 262 in such a resting state (e.g., about axis B in the direction of arrow R1 or arrow R2) would not be translated into a rotation of dial gear 252. In order to reconfigure gear assembly 240 from such a resting state into an active state, a user may first apply an upward force (e.g., in the +Z direction along axis B) on gear subassembly 260 (e.g., via handle 266), such that gear 262 may be moved upwards by the spacing distance in order to contact gear 252 (e.g., such that teeth of gear 262 may mesh with teeth of gear 252), and then the user may apply a rotation force (e.g., in the direction of arrow R2 about axis B) to user gear subassembly 260 (e.g., via handle 266) for rotating meshed dial gear 252 in the direction of arrow R1 about axis A. This may help prevent unintentional rotation of dial 230 and, thus, unintentional updating of exposed dial indicia 236.

By positioning at least a portion of base 270 and/or gear assembly 240 within a dial space 233 within dial 230 (e.g., by positioning at least a portion of base 270 and/or at least a portion of gear assembly 240 above bottom 239 of dial 230), a height of indicia space 283 between top 221 and bottom 279 of assembly 200 may be shorter than a height of indicia space 183 between top 121 and bottom 179 of assembly 100 for a given height of a dial (e.g., along the Z-axis), which may reduce the overall height of the cap subassembly. Additionally or alternatively, by positioning at least a portion of base 270 and/or gear assembly 240 within a dial space 233 within dial 230 (e.g., by positioning at least a portion of base 270 and/or at least a portion of gear assembly 240 above bottom 239 of dial 230), a distance between bottom dial indicia 236*b* on bottom dial wall 239 and base indicia passageway 276 through base 270 of assembly 200 may be shorter than a distance between bottom dial indicia 136*b* on bottom dial wall 139 and base indicia passageway 176 through base 170 of assembly 100 (e.g., along the Z-axis), which may increase a user's ability to view the bottom dial indicia.

Figure 8:
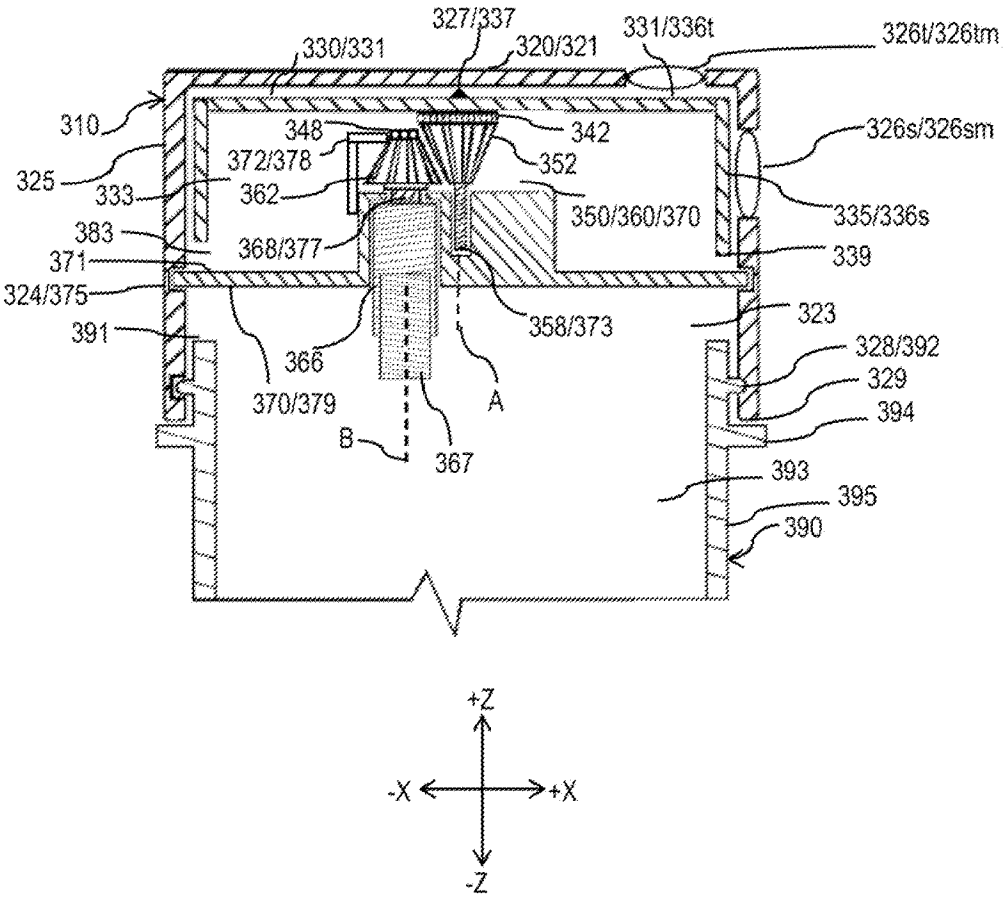
FIG. 8 is a cross-sectional view, similar to FIGS. 6 and 7, of a portion of yet another embodiment of a container assembly.

FIG. 8 (Assembly 300)

FIG. 8 shows another illustrative bottle container assembly 300, which may be similar to assembly 100 of FIGS. 1-6 but may include a hollow dial within which at least a portion of a gear assembly may reside. Assembly 300 of FIG. 8 may include similar components to assembly 100 of FIGS. 1-6, with components of assembly 300 of FIG. 8 being labeled with "3xx" reference labels that may correspond to the "1xx" reference labels of the labeled components of assembly 100 of FIGS. 1-6, where differences therebetween may be described below. As shown, assembly 300 may include a bottle 390 and a cap 310 that may be coupled to bottle 390 for forming a closed container that may safely hold content therein. For example, bottle 390 may include a bottle body that may include one or more side walls 395 that may extend from a closed bottom end (not shown) to an at least partially open top end 391 for defining an interior bottle space 393. Bottle 390 may be configured such that a user may insert content (not shown) through open end 391 into bottle space 393 (e.g., along the −Z direction) and/or may remove content from bottle space 393 through open end 391 (e.g., along the +Z direction). Bottle 390 may be any suitable container portion that may be configured to hold any suitable content in any suitable way. Bottle 390 may be made of any suitable material or combination of materials and may be of any suitable dimensions.

Cap 310 may be configured to be removably coupled to bottle 390, such that cap 310 may cover open end 391 for preventing a user from accessing bottle space 393 when cap 310 is coupled to bottle 390, and such that cap 310 may not cover at least a portion of open end 391 for enabling a user to access bottle space 393 when cap 310 is not coupled to bottle 390. Assembly 300 may be configured in any suitable way for enabling cap subassembly to be removably coupled to bottle 390. As just one example, bottle 390 may include at least one cap attachment feature 392 and cap 310 may include at least one bottle attachment feature 328, where cap attachment feature 392 and bottle attachment feature 328 may be any suitable combination of reciprocal or otherwise related features that may be configured to interact with each other for removably coupling cap 310 to bottle 390 (e.g., threads, snaps, notches, clips, location or transition fits, etc.). Bottle 390 may also include a lip 394, which may protrude from an exterior surface of body 395 below cap attachment feature 392, where lip 394 may be configured to suspend cap subassembly 310 by at least a certain distance above the closed end. Cap attachment feature 392 and/or lip 394 may ensure a specific relationship between cap 310 and bottle 390 when cap 310 is coupled to bottle 390.

Cap 310 may include a closure 320, a dial 330, a gear assembly 340, and a base 370. Closure 320 of cap 310 may include a closure body that may include one or more side walls 325 that may extend from an at least partially closed top end 321 to an at least partially open bottom end 329 for defining an interior closure space 323. Closure 320 may also include one or more closure indicia passageways 326 through any suitable portions of closure 320 for selectively exposing to a user one or more other portions of cap subassembly 300 (e.g., portions of dial 330, as described below). As shown, closure indicia passageways 326 may include at least one top closure indicia passageway 326*t* that may be provided through the wall of top end 321 of closure 320 and/or at least one side closure indicia passageway 326*s* that may be provided through one or more side walls 325 of closure 320. As described below, each closure indicia passageway 326 may be a hollow opening through a wall or other portion of closure 320 or may be such an opening that may be covered by or otherwise configured to include a transparent or translucent material or any other suitable object (e.g., a magnifying glass 326*tm*, 326*sm*, etc.) that may enable communication of information therethrough to a user of assembly 300. Closure 320 may be made of any suitable material or combination of materials and may be of any suitable dimensions.

Dial 330 of cap 310 may include a dial body that may include one or more side walls 335 that may extend from an at least partially closed top end 331 to an open bottom end 339. Unlike dial 130, which may be a solid or closed shape, dial 330 may define an interior dial space 333, which may be accessible via open bottom end 339. Dial 330 may include any suitable dial indicia 336 on any suitable portions of dial 330 for selective display to a user of assembly 300. As shown, dial indicia 336 may include top dial indicia 336*t* that may be provided on an exterior surface of top end 331 of dial 330, and/or side dial indicia 336*s* that may be provided on an exterior surface of one or more side walls 335 of dial 330. Dial 330 may be configured to fit at least partially within closure space 323, such that dial 330 may be moved within closure space 323 with respect to closure 320 for selectively aligning different dial indicia 336 of dial 330 with a closure indicia passageway 326 of closure 320. Dial 330 may be made of any suitable material or combination of materials and may be of any suitable dimensions.

Base 370 of cap 310 may include a base body that may include one or more side walls 375 that may extend from an at least partially closed top end 371 to an at least partially closed bottom end 379. Base 370 may be configured to be coupled (e.g., permanently or removably) to closure 320, such that, for example, base 370 and closure 320 may together define at least a portion of an indicia space 383 within which dial 330 may be positioned. For example, base 370 may include at least one closure attachment feature (e.g., the shape of an exterior surface of side wall(s) 375 of base 370) and closure 320 may include at least one base attachment feature 324 (e.g., one or more grooves or female threads protruding from an interior surface of closure 320), where base 370 may snap into or otherwise fit base 370 within base attachment feature 324 for securing base 370 within closure space 323, which may thereby define a reduced indicia space 383 between closure 320 and base 370. Base attachment feature 324 may be positioned above bottle attachment feature 328 within closure space 323 of closure 320 such that base 370 may be coupled to closure 320 while still enabling bottle attachment feature 328 to removably couple closure 320 to bottle 390. While closure space 323 may be defined by the interior surface(s) of side wall(s) 325, top end 321, and bottom end 329 of closure 320, indicia space 383 may be defined by the interior surface(s) of side wall(s) 325 and top end 321 of closure 320 as well as by base 370, such that indicia space 383 may be a portion of closure space 323. Thus, base 370 may be configured to fit at least partially within closure space 323, such that base 370 may define at least a portion of the bottom of indicia space 383. Base 370 may be made of any suitable material or combination of materials and may be of any suitable dimensions. Dial 330 may be at least partially positioned within indicia space 383 when base 370 is coupled to closure 320. Moreover, as shown, unlike assembly 100, at least a portion of base 370 may be positioned within dial space 333.

Gear assembly 340 of cap 310 may be at least partially positioned within indicia space 383 along with dial 330, and gear assembly 340 may be configured to selectively move dial 330 within indicia space 383 with respect to closure 320 for selectively aligning different dial indicia 336 with a closure indicia passageway 326 of closure 320. Moreover, as shown, unlike assembly 100, at least a portion of gear assembly 340 may be positioned within dial space 333. Gear assembly 340 may include one or more gears that may be configured to translate a user motion that may be applied to a first portion of gear assembly 340 into movement of dial 330 with indicia space 383 (e.g., rotation of dial 330 about an axis A along a Z-axis). As shown, gear assembly 340 may include an upper or dial gear subassembly 350 and a lower or user gear subassembly 360. Dial gear subassembly 350 may include an upper or dial cogwheel or gear 352 and, in some embodiments, an upper or dial gear shaft 358 that may extend away from gear 352 along an axis of rotation of gear 352 (e.g., axis A along a Z-axis). User gear subassembly 360 may include a lower or user cogwheel or gear 362 and, in some embodiments, a lower or user gear shaft 368 that may extend away from gear 362 along an axis of rotation of gear 362 (e.g., axis B along a Z-axis that may be parallel to axis A). User gear subassembly 360 may also include a user handle 366 that may be coupled to a portion of gear 362 (e.g., at an end of gear shaft 368), such that a user may apply a user force or motion to handle 366 for rotating gear 362. Gear assembly 340 may be configured such that rotation of gear 362 may be configured to rotate or otherwise translate gear 352, which may be configured to rotate or otherwise translate dial 330 with respect to closure 320 within indicia space 383. For example, as shown, gear 362 may include teeth or cogs or any other suitable mechanical feature that may mesh with teeth or cogs or any other suitable mechanical feature of gear 352 to transmit torque therebetween within gear assembly 340 (e.g., as a transmission or gearbox).

Base 370 may be configured to support at least a portion of gear assembly 340 and/or dial 330 within indicia space 383 when base 370 is coupled to closure 320. For example, as shown, at least a portion of user gear subassembly 360 (e.g., a bottom portion of gear 362) may be configured to rest against base 370 (e.g., against an exterior surface of top wall 371 of base 370). A user gear shaft opening 377 may be provided through base 370 (e.g., between top wall 371 and bottom wall 379) for enabling at least a portion of user gear shaft 368 and/or user handle 366 to extend therethrough from indicia space 383 to at least a portion of closure space 323 and/or bottle space 393 or for at least enabling a portion of gear subassembly 360 to be accessible therethrough, such that a portion of gear assembly 340 may be accessible to a user when cap 310 is not coupled to bottle 390 (e.g., when a user unscrews cap 310 from bottle 390 for accessing contents 397). Such accessibility to a portion of gear subassembly 360 by a user external to indicia space 383 (e.g., via user gear shaft opening 377 of base 370) may enable a user of assembly 300 to apply a user force or motion to handle 366 for rotating gear 362. Alternatively or additionally, in some embodiments, user gear shaft opening 377 of base 370 may at least partially define an axis of rotation of user gear 362 and/or may otherwise limit at least a portion of a path along which at least a portion of user gear subassembly 360 may travel (e.g., by preventing or limiting movement of gear subassembly 360 along the X-axis and/or along the Y-axis within indicia space 383). For example, as shown, user gear 362 may be configured to rotate about an axis B, and gear shaft 368 may extend away from gear 362 along axis B, such that gear shaft opening 377 may align with axis B. Additionally or alternatively, as shown, at least a portion of dial gear subassembly 350 (e.g., a top portion of gear 352) may be coupled to dial 330 (e.g., to an interior surface of top wall 331 of dial 330 within dial space 333), such that movement of gear subassembly 350 may provide movement of dial 330 (e.g., rotational movement about axis A). In some embodiments, a dial gear shaft opening 373 may be provided through at least a portion of base 370 (e.g., through top wall 371), where opening 373 may at least partially define an axis of rotation of dial gear 352 and/or may otherwise limit at least a portion of a path along which at least a portion of dial gear subassembly 350 may travel (e.g., by preventing or limiting movement of gear subassembly 350 along the X-axis and/or along the Y-axis within indicia space 383). For example, as shown, dial gear 352 may be configured to rotate about an axis A, and gear shaft 358 may extend away from gear 352 along axis A, such that gear shaft opening 373 may align with axis A. However, in some embodiments, gear shaft opening 373 and/or gear shaft 358 may not be necessary and other features of assembly 300 may define axis A about which gear 352 may rotate. For example, the positioning of base 370, gear subassembly 360, and dial 330 within indicia space 383 may limit the manner in which gear subassembly 350 may move within indicia space 383 (e.g., only to movement about axis A). In some embodiments, as shown in FIG. 8, an interior surface of top end 321 of closure 320 may include a dial movement feature 327 and an exterior surface of top end 331 of dial 330 may include a closure movement feature 337, where such features 327 and 337 may interact with one another to at least partially define an axis of rotation of dial 330 with respect to closure 320 (e.g., axis A) or otherwise aid or limit such movement (e.g., by preventing or limiting movement of dial 330 along the X-axis and/or along the Y-axis within indicia space 383), for example, where feature 337 may be a nub that may extend into a cut out or notch 327. In some embodiments, the thickness of the wall of top end 331 of dial 330 along the Z-axis combined with the thickness of gear assembly 340 along the Z-axis may be substantially equal to or slightly less than a thickness of indicia space 383 along the Z-axis, such that dial 330 and/or gear assembly 340 may be prevented or limited with respect to movement along the Z-axis.

As just one example of use, a user may interact with handle 366 of user gear subassembly 360, as may be accessible to a user through opening 377 of base 370, for rotating gear shaft 368 and/or gear 362 in the direction of arrow R2 about axis B, which may in turn rotate gear 352 of dial subassembly 350 in the direction of arrow R1 about axis A, which may in turn rotate dial 330 in the direction of arrow R1 about axis A. Such rotation of dial 330 in the direction of arrow R1 about axis A within indicia space 383 with respect to closure 320 may alter the particular portion of dial 330 and, thus, the particular portion of dial indicia 336 that may be aligned with a particular closure indicia passageway 326, which may alter what information may be provided to a user of assembly 300 by that particular portion of dial indicia 336. For example, as shown in FIG. 8, when dial 330 is at a first particular orientation with respect to closure 320 and base 370 within indicia space 383, a first indication of top dial indicia **336*t* may be aligned with and visible through indicia passageway 326*t* and/or a first indication of side dial indicia 336*s* may be aligned with and visible through indicia passageway 326*s*. However, when dial 330 is rotated in the direction of arrow R1 about axis A within indicia space 383 with respect to closure 320 from such a first orientation to a second orientation, the particular portion of dial 330 and, thus, the particular portion of dial indicia 336 that may be aligned with such indicia passageways 326 may be altered. As shown, handle 366 may include a telescopic (e.g., antenna-like) arm 367 that may be configured to extend from a first short state within gear shaft 368 to a second elongated state at least partially elongated outside of gear shaft 368 (e.g., as shown in FIG. 8), which may enable handle 366 to elongate for easier use by a user and then retract within shaft 368 so as not to extend (too far) out from indicia space 383 so as to interfere with content of bottle 390 or a factory protective seal that may be initially provided by bottle 390 (e.g., across top 391**).

While cap subassembly 310 may be configured to enable rotation of dial 330 in the direction of arrow R1 about axis A within indicia space 383 with respect to closure 320 from a first orientation to a second orientation (e.g., to keep track of a medication schedule for content of bottle 390) by enabling user rotation of handle 366 in the direction of arrow R2 about axis B, cap subassembly 310 may be configured to prevent rotation of dial 330 in the opposite direction of arrow R2 about axis A. For example, as shown, gear assembly 340 may include a ratchet component 348 and base 370 may include a stopper component 372 that may be configured to interact with ratchet component 348 for preventing rotation of gear subassembly 360 in the direction of arrow R1 and, thus, rotation of gear 350 and dial 330 in the direction of arrow R2 while enabling rotation of gear subassembly 350 in the direction of arrow R1. For example, as shown, ratchet component 348 may be provided along a portion of gear subassembly 360 (e.g., adjacent a top portion of gear 362) and base 370 may provide stopper component 372 just adjacent ratchet component 348 in the −X direction (e.g., at the top end of an extension body 378 that may extend from a top surface 371 of the base body of base 370), such that a free end of stopper component 372 may enable rotation of ratchet component 348 and, thus, gear 360 in the direction of arrow R2 about axis A and, thus gear 350 and dial 330 in the direction of arrow R1 about axis A and at the same time prevent rotation of ratchet component 348 and, thus, gear 362 in the direction of arrow R1 about axis A and, thus, gear 352 and dial 330 in the direction of arrow R2 about axis A (e.g., due to the geometrical relationship between teeth or other suitable features of ratchet component 348 and the free end of stopper component 372). Moreover, interaction of ratchet component 348 and stopper component 372 may provide a user with an audible and/or tactile feedback to user adjustment of the indicia of assembly 300. In some embodiments, stopper component 372 may be tensioned by a suitable amount such that the free end of stopper component 372 may exert a suitable force on ratchet component 348 for even preventing rotation of dial 330 in the direction of arrow R1 about axis A, where such a force may be overcome by an intentional user force on handle 366 but that may not be overcome by any unintentional forces to which cap subassembly 310 may be susceptible during normal use of assembly 300, such that components 348/372 may enable proper rotation of dial 330 in the direction of arrow R1 but only if at least a certain amount of threshold force is applied to gear assembly 340 (e.g., to handle 366). Therefore, a stopper component may be configured to interact with a ratchet component coupled to a user gear subassembly rather than with a ratchet component coupled to a dial gear subassembly.

Additionally or alternatively to being provided with ratchet component and stopper component (e.g., ratchet component 348 and stopper component 372), gear assembly 340 may be configured to have a resting state in which movement of gear subassembly 350 may not translate into motion of gear subassembly 360 (and vice versa) and an active state in which movement of gear subassembly 350 may translate into motion of gear subassembly 360 (and vice versa). For example, as shown in FIG. 8, gear assembly 340 may be in a resting state, whereby a spacing distance (e.g., similar to spacing distance 141) may exist between gear 352 and gear 362 (e.g., along the X-axis and/or along the Z-axis of FIG. 8), such that any rotation of user gear 362 in such a resting state (e.g., about axis B in the direction of arrow R1 or arrow R2) would not be translated into a rotation of dial gear 352. In order to reconfigure gear assembly 340 from such a resting state into an active state, a user may first apply an upward force (e.g., in the +Z direction along axis B) on gear subassembly 360 (e.g., via handle 366), such that gear 362 may be moved upwards by the spacing distance in order to contact gear 352 (e.g., such that teeth of gear 362 may mesh with teeth of gear 352), and then the user may apply a rotation force (e.g., in the direction of arrow R2 about axis B) to user gear subassembly 360 (e.g., via handle 366) for rotating meshed dial gear 352 in the direction of arrow R1 about axis A. This may help prevent unintentional rotation of dial 330 and, thus, unintentional updating of exposed dial indicia 336.

By positioning at least a portion of base 370 and/or gear assembly 340 within a dial space 333 within dial 330 (e.g., by positioning at least a portion of base 370 and/or at least a portion of gear assembly 340 above bottom 339 of dial 330), a height of indicia space 383 between top 321 and bottom 379 of assembly 300 may be shorter than a height of indicia space 183 between top 121 and bottom 179 of assembly 100 for a given height of a dial (e.g., along the Z-axis), which may reduce the overall height of the cap subassembly.

Figure 9:
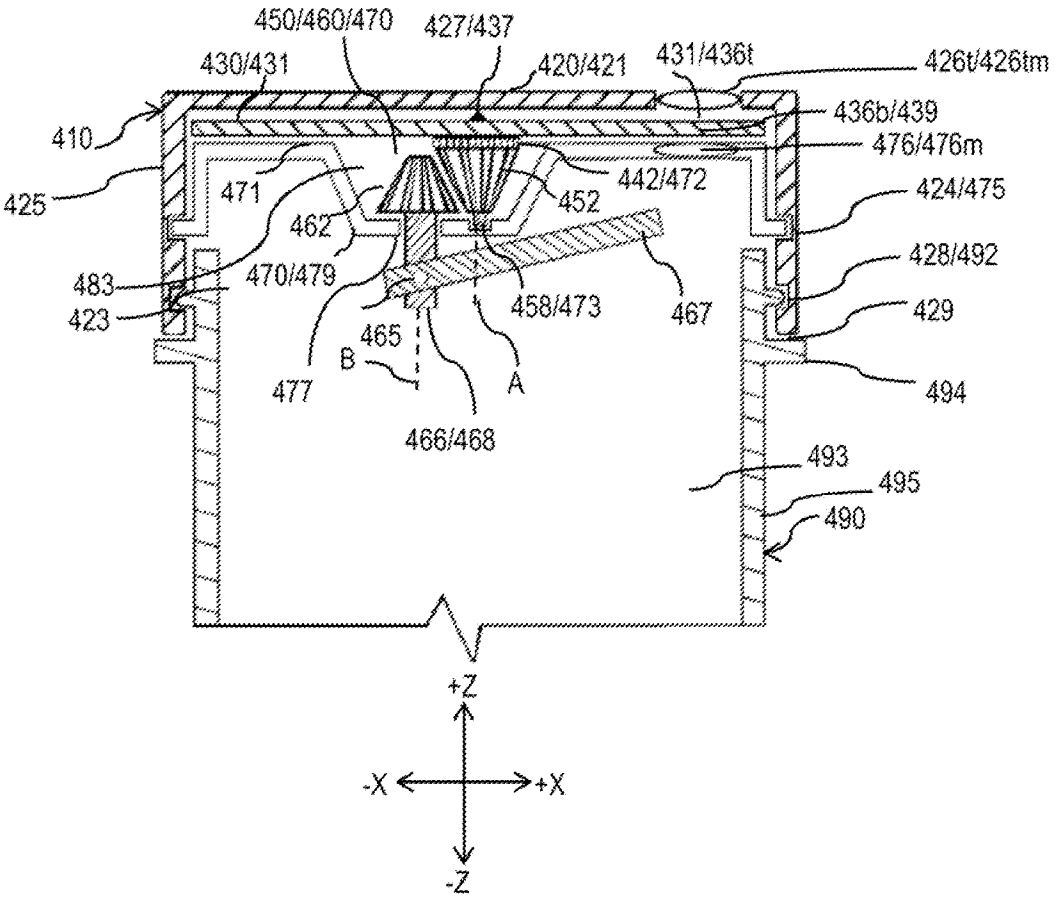
FIG. 9 is a cross-sectional view, similar to FIGS. 6-8, of a portion of yet another embodiment of a container assembly.

FIG. 9 (Assembly 400)

FIG. 9 shows another illustrative bottle container assembly 400, which may be similar to assembly 100 of FIGS. 1-6 but may include a flat dial and a reduced profile base. Assembly 400 of FIG. 9 may include similar components to assembly 100 of FIGS. 1-6, with components of assembly 400 of FIG. 9 being labeled with "4xx" reference labels that may correspond to the "1xx" reference labels of the labeled components of assembly 100 of FIGS. 1-6, where differences therebetween may be described below. As shown, assembly 400 may include a bottle 490 and a cap 410 that may be coupled to bottle 490 for forming a closed container that may safely hold content therein. For example, bottle 490 may include a bottle body that may include one or more side walls 495 that may extend from a closed bottom end (not shown) to an at least partially open top end 491 for defining an interior bottle space 493. Bottle 490 may be configured such that a user may insert content (not shown) through open end 491 into bottle space 493 (e.g., along the −Z direction) and/or may remove content from bottle space 493 through open end 491 (e.g., along the +Z direction). Bottle 490 may be any suitable container portion that may be configured to hold any suitable content in any suitable way. Bottle 490 may be made of any suitable material or combination of materials and may be of any suitable dimensions.

Cap 410 may be configured to be removably coupled to bottle 490, such that cap 410 may cover open end 491 for preventing a user from accessing bottle space 493 when cap 410 is coupled to bottle 490, and such that cap 410 may not cover at least a portion of open end 491 for enabling a user to access bottle space 493 when cap 410 is not coupled to bottle 490. Assembly 400 may be configured in any suitable way for enabling cap subassembly to be removably coupled to bottle 490. As just one example, bottle 490 may include at least one cap attachment feature 492 and cap 410 may include at least one bottle attachment feature 428, where cap attachment feature 492 and bottle attachment feature 428 may be any suitable combination of reciprocal or otherwise related features that may be configured to interact with each other for removably coupling cap 410 to bottle 490 (e.g., threads, snaps, notches, clips, location or transition fits, etc.). Bottle 490 may also include a lip 494, which may protrude from an exterior surface of body 495 below cap attachment feature 492, where lip 494 may be configured to suspend cap subassembly 410 by at least a certain distance above the closed end. Cap attachment feature 492 and/or lip 494 may ensure a specific relationship between cap 410 and bottle 490 when cap 410 is coupled to bottle 490.

Cap 410 may include a closure 420, a dial 430, a gear assembly 440, and a base 470. Closure 420 of cap 410 may include a closure body that may include one or more side walls 425 that may extend from an at least partially closed top end 421 to an at least partially open bottom end 429 for defining an interior closure space 423. Closure 420 may also include one or more closure indicia passageways 426 through any suitable portions of closure 420 for selectively exposing to a user one or more other portions of cap subassembly 400 (e.g., portions of dial 430, as described below). As shown, closure indicia passageways 426 may include at least one top closure indicia passageway **426*t* that may be provided through the wall of top end 421 of closure 420. As described below, each closure indicia passageway 426 may be a hollow opening through a wall or other portion of closure 420 or may be such an opening that may be covered by or otherwise configured to include a transparent or translucent material or any other suitable object (e.g., a magnifying glass 426*tm*) that may enable communication of information therethrough to a user of assembly 400. Closure 420** may be made of any suitable material or combination of materials and may be of any suitable dimensions.

Dial 430 of cap 410 may include a dial body that may include one or more side walls that may extend from an at least partially closed top end 431 to an at least partially closed bottom end 439. Unlike dial 230, which may be an at least partially open shape and/or include a side dial indicia, dial 430 may be a relatively thin closed dial (e.g., along the Z-axis) with no side dial indicia, which may reduce the thickness of cap 410. Dial 430 may include any suitable dial indicia 436 on any suitable portions of dial 430 for selective display to a user of assembly 400. As shown, dial indicia 436 may include top dial indicia **436*t* that may be provided on an exterior surface of top end 431 of dial 430, and/or bottom dial indicia 436*b* that may be provided on an exterior surface of bottom end 439. Dial 430 may be configured to fit at least partially within closure space 423, such that dial 430 may be moved within closure space 423 with respect to closure 420 for selectively aligning different dial indicia 436 of dial 430 with a closure indicia passageway 426 of closure 420 and/or a base indicia passageway 476 of base 470 (described below). Dial 430** may be made of any suitable material or combination of materials and may be of any suitable dimensions.

Base 470 of cap 410 may include a base body that may include one or more side walls 475 that may extend from an at least partially closed top end 471 to an at least partially closed bottom end 479. Base 470 may be configured to be coupled (e.g., permanently or removably) to closure 420, such that, for example, base 470 and closure 420 may together define at least a portion of an indicia space 483 within which dial 430 may be positioned. For example, base 470 may include at least one closure attachment feature (e.g., the shape of an exterior surface of side wall(s) 475 of base 470) and closure 420 may include at least one base attachment feature 424 (e.g., one or more grooves or female threads protruding from an interior surface of closure 420), where base 470 may snap into or otherwise fit base 470 within base attachment feature 424 for securing base 470 within closure space 423, which may thereby define a reduced indicia space 483 between closure 420 and base 470. Base attachment feature 424 may be positioned above bottle attachment feature 428 within closure space 423 of closure 420 such that base 470 may be coupled to closure 420 while still enabling bottle attachment feature 428 to removably couple closure 420 to bottle 490. While closure space 423 may be defined by the interior surface(s) of side wall(s) 425, top end 421, and bottom end 429 of closure 420, indicia space 483 may be defined by the interior surface(s) of side wall(s) 425 and top end 421 of closure 420 as well as by base 470, such that indicia space 483 may be a portion of closure space 423. Thus, base 470 may be configured to fit at least partially within closure space 423, such that base 470 may define at least a portion of the bottom of indicia space 483. Base 470 may be made of any suitable material or combination of materials and may be of any suitable dimensions. Dial 430 may be at least partially positioned within indicia space 483 when base 470 is coupled to closure 420. Base 470 may have less material than base 270 or base 370, and a thickness of base 470 (e.g., along the Z-axis) may be substantially constant while portions of base 470 may run adjacently along bottom 439 of dial 430 (e.g., to support dial 430).

Gear assembly 440 of cap 410 may be at least partially positioned within indicia space 483 along with dial 430, and gear assembly 440 may be configured to selectively move dial 430 within indicia space 483 with respect to closure 420 for selectively aligning different dial indicia 436 with a closure indicia passageway 426 of closure 420. Gear assembly 440 may include one or more gears that may be configured to translate a user motion that may be applied to a first portion of gear assembly 440 into movement of dial 430 with indicia space 483 (e.g., rotation of dial 430 about an axis A along a Z-axis). As shown, gear assembly 440 may include an upper or dial gear subassembly 450 and a lower or user gear subassembly 460. Dial gear subassembly 450 may include an upper or dial cogwheel or gear 452 and, in some embodiments, an upper or dial gear shaft 458 that may extend away from gear 452 along an axis of rotation of gear 452 (e.g., axis A along a Z-axis). User gear subassembly 460 may include a lower or user cogwheel or gear 462 and, in some embodiments, a lower or user gear shaft 468 that may extend away from gear 462 along an axis of rotation of gear 462 (e.g., axis B along a Z-axis that may be parallel to axis A). User gear subassembly 460 may also include a user handle 466 that may be coupled to a portion of gear 462 (e.g., at an end of gear shaft 468), such that a user may apply a user force or motion to handle 466 for rotating gear 462. Gear assembly 440 may be configured such that rotation of gear 462 may be configured to rotate or otherwise translate gear 452, which may be configured to rotate or otherwise translate dial 430 with respect to closure 420 within indicia space 483. For example, as shown, gear 462 may include teeth or cogs or any other suitable mechanical feature that may mesh with teeth or cogs or any other suitable mechanical feature of gear 452 to transmit torque therebetween within gear assembly 440 (e.g., as a transmission or gearbox).

Base 470 may be configured to support at least a portion of gear assembly 440 and/or dial 430 within indicia space 483 when base 470 is coupled to closure 420. For example, as shown, at least a portion of user gear subassembly 460 (e.g., a bottom portion of gear 462) may be configured to rest against base 470 (e.g., against an exterior surface of top wall 471 of base 470). A user gear shaft opening 477 may be provided through base 470 (e.g., between top wall 471 and bottom wall 479) for enabling at least a portion of user gear shaft 468 and/or user handle 466 to extend therethrough from indicia space 483 to at least a portion of closure space 423 and/or bottle space 493 or for at least enabling a portion of gear subassembly 460 to be accessible therethrough, such that a portion of gear assembly 440 may be accessible to a user when cap 410 is not coupled to bottle 490 (e.g., when a user unscrews cap 410 from bottle 490 for accessing contents 497). Such accessibility to a portion of gear subassembly 460 by a user external to indicia space 483 (e.g., via user gear shaft opening 477 of base 470) may enable a user of assembly 400 to apply a user force or motion to handle 466 for rotating gear 462. Alternatively or additionally, in some embodiments, user gear shaft opening 477 of base 470 may at least partially define an axis of rotation of user gear 462 and/or may otherwise limit at least a portion of a path along which at least a portion of user gear subassembly 460 may travel (e.g., by preventing or limiting movement of gear subassembly 460 along the X-axis and/or along the Y-axis within indicia space 483). For example, as shown, user gear 462 may be configured to rotate about an axis B, and gear shaft 468 may extend away from gear 462 along axis B, such that gear shaft opening 477 may align with axis B. Additionally or alternatively, as shown, at least a portion of dial gear subassembly 450 (e.g., a top portion of gear 452) may be coupled to dial 430 (e.g., to bottom wall 439 of dial 430), such that movement of gear subassembly 450 may provide movement of dial 430 (e.g., rotational movement about axis A). In some embodiments, a dial gear shaft opening 473 may be provided through at least a portion of base 470 (e.g., through top wall 471), where opening 473 may at least partially define an axis of rotation of dial gear 452 and/or may otherwise limit at least a portion of a path along which at least a portion of dial gear subassembly 450 may travel (e.g., by preventing or limiting movement of gear subassembly 450 along the X-axis and/or along the Y-axis within indicia space 483). For example, as shown, dial gear 452 may be configured to rotate about an axis A, and gear shaft 458 may extend away from gear 452 along axis A, such that gear shaft opening 473 may align with axis A. However, in some embodiments, gear shaft opening 473 and/or gear shaft 458 may not be necessary and other features of assembly 400 may define axis A about which gear 452 may rotate. For example, the positioning of base 470, gear subassembly 460, and dial 430 within indicia space 483 may limit the manner in which gear subassembly 450 may move within indicia space 483 (e.g., only to movement about axis A). In some embodiments, as shown in FIG. 9, an interior surface of top end 421 of closure 420 may include a dial movement feature 427 and an exterior surface of top end 431 of dial 430 may include a closure movement feature 437, where such features 427 and 437 may interact with one another to at least partially define an axis of rotation of dial 430 with respect to closure 420 (e.g., axis A) or otherwise aid or limit such movement (e.g., by preventing or limiting movement of dial 430 along the X-axis and/or along the Y-axis within indicia space 483), for example, where feature 437 may be a nub that may extend into a cut out or notch 427. In some embodiments, the thickness of the wall of top end 431 of dial 430 along the Z-axis combined with the thickness of gear assembly 440 along the Z-axis may be substantially equal to or slightly less than a thickness of indicia space 483 along the Z-axis, such that dial 430 and/or gear assembly 440 may be prevented or limited with respect to movement along the Z-axis.

As just one example of use, a user may interact with handle 466 of user gear subassembly 460, as may be accessible to a user through opening 477 of base 470, for rotating gear shaft 468 and/or gear 462 in the direction of arrow R2 about axis B, which may in turn rotate gear 452 of dial subassembly 450 in the direction of arrow R1 about axis A, which may in turn rotate dial 430 in the direction of arrow R1 about axis A. Such rotation of dial 430 in the direction of arrow R1 about axis A within indicia space 483 with respect to closure 420 may alter the particular portion of dial 430 and, thus, the particular portion of dial indicia 436 that may be aligned with a particular closure indicia passageway 426, which may alter what information may be provided to a user of assembly 400 by that particular portion of dial indicia 436. For example, as shown in FIG. 9, when dial 430 is at a first particular orientation with respect to closure 420 and base 470 within indicia space 483, a first indication of top dial indicia 436*t* may be aligned with and visible through indicia passageway 426*t* and/or a first indication of bottom dial indicia 436*b* may be aligned with and visible through indicia passageway 476 of base 470. However, when dial 430 is rotated in the direction of arrow R1 about axis A within indicia space 483 with respect to closure 420 from such a first orientation to a second orientation, the particular portion of dial 430 and, thus, the particular portion of dial indicia 436 that may be aligned with such indicia passageways 426/476 may be altered. As shown, handle 466 may include a rotatable arm 467 about a pivot 465 of shaft 468 that may be configured to rotate from a first short state (e.g., with respect to the Z-axis) such that arm 467 may extend up towards base 470 (e.g., as shown in FIG. 9) to a second elongated state (e.g., with respect to the Z-axis), which may enable handle 466 to elongate for easier use by a user and then rotatably retract so as not to extend (e.g., too far) out away from base 470 and/or indicia space 483 so as to interfere with content of bottle 490 or a factory protective seal that may be initially provided by bottle 490 (e.g., across top 491). Such rotation of arm 467 with respect to shaft 468 may enable easier rotation of shaft 468 about axis B through rotation of the free end of arm 467 about axis B and within an X-Y plane, which may provide a user with additional leverage than may be provided by a free end of shaft 468.

While cap subassembly 410 may be configured to enable rotation of dial 430 in the direction of arrow R1 about axis A within indicia space 483 with respect to closure 420 from a first orientation to a second orientation (e.g., to keep track of a medication schedule for content of bottle 490) by enabling user rotation of handle 466 in the direction of arrow R2 about axis B, cap subassembly 410 may be configured to prevent rotation of dial 430 in the opposite direction of arrow R2 about axis A. For example, as shown, gear assembly 440 may include a ratchet component 442 and base 470 may include a stopper component 472 that may be configured to interact with ratchet component 442 for preventing rotation of gear subassembly 450 in the direction of arrow R2 while enabling rotation of gear subassembly 450 in the direction of arrow R1. For example, as shown, ratchet component 442 may be provided along a portion of gear subassembly 450 (e.g., adjacent a top portion of gear 452) and base 470 may provide stopper component 472 just adjacent ratchet component 442 in the +X direction (e.g., as an extension of a portion of top surface 471 of the base body of base 470), such that a free end of stopper component 472 may enable rotation of ratchet component 442 and, thus, gear 450 and dial 430 in the direction of arrow R1 about axis A and at the same time prevent rotation of ratchet component 442 and, thus, gear 452 and dial 430 in the direction of arrow R2 about axis A (e.g., due to the geometrical relationship between teeth or other suitable features of ratchet component 442 and the free end of stopper component 472). Moreover, interaction of ratchet component 442 and stopper component 472 may provide a user with an audible and/or tactile feedback to user adjustment of the indicia of assembly 400. In some embodiments, stopper component 472 may be tensioned by a suitable amount such that the free end of stopper component 472 may exert a suitable force on ratchet component 442 for even preventing rotation of dial 430 in the direction of arrow R1 about axis A, where such a force may be overcome by an intentional user force on handle 466 but that may not be overcome by any unintentional forces to which cap subassembly 410 may be susceptible during normal use of assembly 400, such that components 442/472 may enable proper rotation of dial 430 in the direction of arrow R1 but only if at least a certain amount of threshold force is applied to gear assembly 440 (e.g., to handle 466).

Additionally or alternatively to being provided with ratchet component and stopper component (e.g., ratchet component 442 and stopper component 472), gear assembly 440 may be configured to have a resting state in which movement of gear subassembly 450 may not translate into motion of gear subassembly 460 (and vice versa) and an active state in which movement of gear subassembly 450 may translate into motion of gear subassembly 460 (and vice versa). For example, as shown in FIG. 9, gear assembly 440 may be in a resting state, whereby a spacing distance (e.g., similar to spacing distance 141) may exist between gear 452 and gear 462 (e.g., along the X-axis and/or along the Z-axis of FIG. 9), such that any rotation of user gear 462 in such a resting state (e.g., about axis B in the direction of arrow R1 or arrow R2) would not be translated into a rotation of dial gear 452. In order to reconfigure gear assembly 440 from such a resting state into an active state, a user may first apply an upward force (e.g., in the +Z direction along axis B) on gear subassembly 460 (e.g., via handle 466), such that gear 462 may be moved upwards by the spacing distance in order to contact gear 452 (e.g., such that teeth of gear 462 may mesh with teeth of gear 452), and then the user may apply a rotation force (e.g., in the direction of arrow R2 about axis B) to user gear subassembly 460 (e.g., via handle 466) for rotating meshed dial gear 452 in the direction of arrow R1 about axis A. This may help prevent unintentional rotation of dial 430 and, thus, unintentional updating of exposed dial indicia 436.

By reducing the thickness of dial 430 while also minimizing the thickness of indicia spacing 483 to only that which may be needed for gear assembly 430, a height of indicia space 483 between top 421 and bottom 479 of assembly 400 may be shorter than a height of indicia space 183 between top 121 and bottom 179 of assembly 100, while a portion of that reduced height may be used to store a portion of a handle 466 (e.g., portion 467) when in a non-use state.

Figure 10:
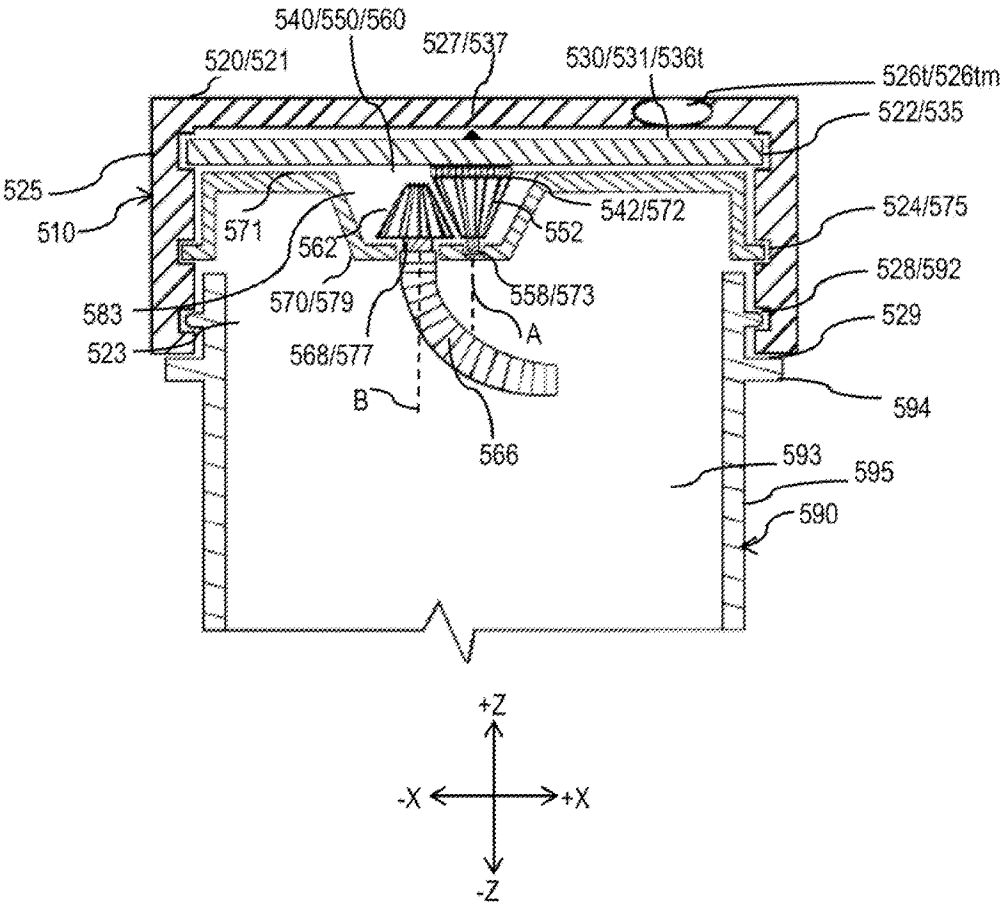
FIG. 10 is a cross-sectional view, similar to FIGS. 6-9, of a portion of yet another embodiment of a container assembly.

FIG. 10 (Assembly 500)

FIG. 10 shows another illustrative bottle container assembly 500, which may be similar to assembly 100 of FIGS. 1-6 but may include a flat dial and a reduced profile base. Assembly 500 of FIG. 10 may include similar components to assembly 100 of FIGS. 1-6, with components of assembly 500 of FIG. 10 being labeled with "5xx" reference labels that may correspond to the "1xx" reference labels of the labeled components of assembly 100 of FIGS. 1-6, where differences therebetween may be described below. As shown, assembly 500 may include a bottle 590 and a cap 510 that may be coupled to bottle 590 for forming a closed container that may safely hold content therein. For example, bottle 590 may include a bottle body that may include one or more side walls 595 that may extend from a closed bottom end (not shown) to an at least partially open top end 591 for defining an interior bottle space 593. Bottle 590 may be configured such that a user may insert content (not shown) through open end 591 into bottle space 593 (e.g., along the −Z direction) and/or may remove content from bottle space 593 through open end 591 (e.g., along the +Z direction). Bottle 590 may be any suitable container portion that may be configured to hold any suitable content in any suitable way. Bottle 590 may be made of any suitable material or combination of materials and may be of any suitable dimensions.

Cap 510 may be configured to be removably coupled to bottle 590, such that cap 510 may cover open end 591 for preventing a user from accessing bottle space 593 when cap 510 is coupled to bottle 590, and such that cap 510 may not cover at least a portion of open end 591 for enabling a user to access bottle space 593 when cap 510 is not coupled to bottle 590. Assembly 500 may be configured in any suitable way for enabling cap subassembly to be removably coupled to bottle 590. As just one example, bottle 590 may include at least one cap attachment feature 592 and cap 510 may include at least one bottle attachment feature 528, where cap attachment feature 592 and bottle attachment feature 528 may be any suitable combination of reciprocal or otherwise related features that may be configured to interact with each other for removably coupling cap 510 to bottle 590 (e.g., threads, snaps, notches, clips, location or transition fits, etc.). Bottle 590 may also include a lip 594, which may protrude from an exterior surface of body 595 below cap attachment feature 592, where lip 594 may be configured to suspend cap subassembly 510 by at least a certain distance above the closed end. Cap attachment feature 592 and/or lip 594 may ensure a specific relationship between cap 510 and bottle 590 when cap 510 is coupled to bottle 590.

Cap 510 may include a closure 520, a dial 530, a gear assembly 540, and a base 570. Closure 520 of cap 510 may include a closure body that may include one or more side walls 525 that may extend from an at least partially closed top end 521 to an at least partially open bottom end 529 for defining an interior closure space 523. Closure 520 may also include one or more closure indicia passageways 526 through any suitable portions of closure 520 for selectively exposing to a user one or more other portions of cap subassembly 500 (e.g., portions of dial 530, as described below). As shown, closure indicia passageways 526 may include at least one top closure indicia passageway **526*t* that may be provided through the wall of top end 521 of closure 520. As described below, each closure indicia passageway 526 may be a hollow opening through a wall or other portion of closure 520 or may be such an opening that may be covered by or otherwise configured to include a transparent or translucent material or any other suitable object (e.g., a magnifying glass 526*tm*) that may enable communication of information therethrough to a user of assembly 500. Closure 520** may be made of any suitable material or combination of materials and may be of any suitable dimensions.

Dial 530 of cap 510 may include a dial body that may include one or more side walls that may extend from an at least partially closed top end 531 to an at least partially closed bottom end 539. Unlike dial 230, which may be an at least partially open shape and/or include a side dial indicia, dial 530 may be a relatively thin closed dial (e.g., along the Z-axis) with no side dial indicia, which may reduce the thickness of cap 510. Dial 530 may include any suitable dial indicia 536 on any suitable portions of dial 530 for selective display to a user of assembly 500. As shown, dial indicia 536 may include top dial indicia **536*t* that may be provided on an exterior surface of top end 531 of dial 530, and/or bottom dial indicia (not shown) that may be provided on an exterior surface of bottom end 539. Dial 530 may be configured to fit at least partially within closure space 523, such that dial 530 may be moved within closure space 523 with respect to closure 520 for selectively aligning different dial indicia 536 of dial 530 with a closure indicia passageway 526 of closure 520 and/or a base indicia passageway of base 570 (not shown). Dial 530 may be made of any suitable material or combination of materials and may be of any suitable dimensions. Unlike dial 130, dial 530 may be configured to be coupled (e.g., permanently or removably) to closure 520, such that, for example, closure 520 may prevent dial 530 from moving (e.g., along the Z-axis). For example, dial 530 may include at least one closure attachment feature (e.g., the shape of an exterior surface of side wall(s) 535 of dial 530) and closure 520 may include at least one dial attachment feature 522 (e.g., one or more grooves or female threads protruding from an interior surface of closure 520), where dial 530 may snap into or otherwise fit dial 530 within dial attachment feature 522 for securing dial 530 within closure space 523. Dial attachment feature 522 may be positioned above both base attachment feature 524 (described below) and bottle attachment feature 528 within closure space 523 of closure 520 such that dial 530 and base 570 may be coupled to closure 520 while still enabling bottle attachment feature 528 to removably couple closure 520 to bottle 590**.

Base 570 of cap 510 may include a base body that may include one or more side walls 575 that may extend from an at least partially closed top end 571 to an at least partially closed bottom end 579. Base 570 may be configured to be coupled (e.g., permanently or removably) to closure 520, such that, for example, base 570 and closure 520 may together define at least a portion of an indicia space 583 within which dial 530 may be positioned. For example, base 570 may include at least one closure attachment feature (e.g., the shape of an exterior surface of side wall(s) 575 of base 570) and closure 520 may include at least one base attachment feature 524 (e.g., one or more grooves or female threads protruding from an interior surface of closure 520), where base 570 may snap into or otherwise fit base 570 within base attachment feature 524 for securing base 570 within closure space 523, which may thereby define a reduced indicia space 583 between closure 520 and base 570. Base attachment feature 524 may be positioned above bottle attachment feature 528 within closure space 523 of closure 520 such that base 570 may be coupled to closure 520 while still enabling bottle attachment feature 528 to removably couple closure 520 to bottle 590. While closure space 523 may be defined by the interior surface(s) of side wall(s) 525, top end 521, and bottom end 529 of closure 520, indicia space 583 may be defined by the interior surface(s) of side wall(s) 525 and top end 521 of closure 520 as well as by base 570, such that indicia space 583 may be a portion of closure space 523. Thus, base 570 may be configured to fit at least partially within closure space 523, such that base 570 may define at least a portion of the bottom of indicia space 583. Base 570 may be made of any suitable material or combination of materials and may be of any suitable dimensions. Dial 530 may be at least partially positioned within indicia space 583 when base 570 is coupled to closure 520. Base 570 may have less material than base 270 or base 370, and a thickness of base 570 (e.g., along the Z-axis) may be substantially constant while portions of base 570 may run adjacently along bottom 539 of dial 530 (e.g., to support dial 530).

Gear assembly 540 of cap 510 may be at least partially positioned within indicia space 583 along with dial 530, and gear assembly 540 may be configured to selectively move dial 530 within indicia space 583 with respect to closure 520 for selectively aligning different dial indicia 536 with a closure indicia passageway 526 of closure 520. Gear assembly 540 may include one or more gears that may be configured to translate a user motion that may be applied to a first portion of gear assembly 540 into movement of dial 530 with indicia space 583 (e.g., rotation of dial 530 about an axis A along a Z-axis). As shown, gear assembly 540 may include an upper or dial gear subassembly 550 and a lower or user gear subassembly 560. Dial gear subassembly 550 may include an upper or dial cogwheel or gear 552 and, in some embodiments, an upper or dial gear shaft 558 that may extend away from gear 552 along an axis of rotation of gear 552 (e.g., axis A along a Z-axis). User gear subassembly 560 may include a lower or user cogwheel or gear 562 and, in some embodiments, a lower or user gear shaft 568 that may extend away from gear 562 along an axis of rotation of gear 562 (e.g., axis B along a Z-axis that may be parallel to axis A). User gear subassembly 560 may also include a user handle 566 that may be coupled to a portion of gear 562 (e.g., at an end of gear shaft 568), such that a user may apply a user force or motion to handle 566 for rotating gear 562. Gear assembly 540 may be configured such that rotation of gear 562 may be configured to rotate or otherwise translate gear 552, which may be configured to rotate or otherwise translate dial 530 with respect to closure 520 within indicia space 583. For example, as shown, gear 562 may include teeth or cogs or any other suitable mechanical feature that may mesh with teeth or cogs or any other suitable mechanical feature of gear 552 to transmit torque therebetween within gear assembly 540 (e.g., as a transmission or gearbox).

Base 570 may be configured to support at least a portion of gear assembly 540 and/or dial 530 within indicia space 583 when base 570 is coupled to closure 520. For example, as shown, at least a portion of user gear subassembly 560 (e.g., a bottom portion of gear 562) may be configured to rest against base 570 (e.g., against an exterior surface of top wall 571 of base 570). A user gear shaft opening 577 may be provided through base 570 (e.g., between top wall 571 and bottom wall 579) for enabling at least a portion of user gear shaft 568 and/or user handle 566 to extend therethrough from indicia space 583 to at least a portion of closure space 523 and/or bottle space 593 or for at least enabling a portion of gear subassembly 560 to be accessible therethrough, such that a portion of gear assembly 540 may be accessible to a user when cap 510 is not coupled to bottle 590 (e.g., when a user unscrews cap 510 from bottle 590 for accessing contents 597). Such accessibility to a portion of gear subassembly 560 by a user external to indicia space 583 (e.g., via user gear shaft opening 577 of base 570) may enable a user of assembly 500 to apply a user force or motion to handle 566 for rotating gear 562. Alternatively or additionally, in some embodiments, user gear shaft opening 577 of base 570 may at least partially define an axis of rotation of user gear 562 and/or may otherwise limit at least a portion of a path along which at least a portion of user gear subassembly 560 may travel (e.g., by preventing or limiting movement of gear subassembly 560 along the X-axis and/or along the Y-axis within indicia space 583). For example, as shown, user gear 562 may be configured to rotate about an axis B, and gear shaft 568 may extend away from gear 562 along axis B, such that gear shaft opening 577 may align with axis B. Additionally or alternatively, as shown, at least a portion of dial gear subassembly 550 (e.g., a top portion of gear 552) may be coupled to dial 530 (e.g., to bottom wall 539 of dial 530), such that movement of gear subassembly 550 may provide movement of dial 530 (e.g., rotational movement about axis A). In some embodiments, a dial gear shaft opening 573 may be provided through at least a portion of base 570 (e.g., through top wall 571), where opening 573 may at least partially define an axis of rotation of dial gear 552 and/or may otherwise limit at least a portion of a path along which at least a portion of dial gear subassembly 550 may travel (e.g., by preventing or limiting movement of gear subassembly 550 along the X-axis and/or along the Y-axis within indicia space 583). For example, as shown, dial gear 552 may be configured to rotate about an axis A, and gear shaft 558 may extend away from gear 552 along axis A, such that gear shaft opening 573 may align with axis A. However, in some embodiments, gear shaft opening 573 and/or gear shaft 558 may not be necessary and other features of assembly 500 may define axis A about which gear 552 may rotate. For example, the positioning of base 570, gear subassembly 560, and dial 530 within indicia space 583 may limit the manner in which gear subassembly 550 may move within indicia space 583 (e.g., only to movement about axis A). In some embodiments, as shown in FIG. 10, an interior surface of top end 521 of closure 520 may include a dial movement feature 527 and an exterior surface of top end 531 of dial 530 may include a closure movement feature 537, where such features 527 and 537 may interact with one another to at least partially define an axis of rotation of dial 530 with respect to closure 520 (e.g., axis A) or otherwise aid or limit such movement (e.g., by preventing or limiting movement of dial 530 along the X-axis and/or along the Y-axis within indicia space 583), for example, where feature 537 may be a nub that may extend into a cut out or notch 527. In some embodiments, the thickness of the wall of top end 531 of dial 530 along the Z-axis combined with the thickness of gear assembly 540 along the Z-axis may be substantially equal to or slightly less than a thickness of indicia space 583 along the Z-axis, such that dial 530 and/or gear assembly 540 may be prevented or limited with respect to movement along the Z-axis.

As just one example of use, a user may interact with handle 566 of user gear subassembly 560, as may be accessible to a user through opening 577 of base 570, for rotating gear shaft 568 and/or gear 562 in the direction of arrow R2 about axis B, which may in turn rotate gear 552 of dial subassembly 550 in the direction of arrow R1 about axis A, which may in turn rotate dial 530 in the direction of arrow R1 about axis A. Such rotation of dial 530 in the direction of arrow R1 about axis A within indicia space 583 with respect to closure 520 may alter the particular portion of dial 530 and, thus, the particular portion of dial indicia 536 that may be aligned with a particular closure indicia passageway 526, which may alter what information may be provided to a user of assembly 500 by that particular portion of dial indicia 536. For example, as shown in FIG. 10, when dial 530 is at a first particular orientation with respect to closure 520 and base 570 within indicia space 583, a first indication of top dial indicia **536*t* may be aligned with and visible through indicia passageway 526*t*. However, when dial 530 is rotated in the direction of arrow R1 about axis A within indicia space 583 with respect to closure 520 from such a first orientation to a second orientation, the particular portion of dial 530 and, thus, the particular portion of dial indicia 536 that may be aligned with such indicia passageway 526 may be altered. As shown, handle 566 may include a flexible arm that may be configured to bend or flex in any suitable direction and/or to any suitable shape (e.g., with respect to the Z-axis) such that handle 566 may extend up towards or at least parallel to base 570 (e.g., as shown in FIG. 10) and then may be bent to a second elongated state (e.g., with respect to the Z-axis), which may enable handle 566 to extend away from base 570 for easier use by a user and then bend towards or along base 570 so as not to extend (too far) out away from base 570 and/or indicia space 583 so as to interfere with content of bottle 590 or a factory protective seal that may be initially provided by bottle 590 (e.g., across top 591**).

While cap subassembly 510 may be configured to enable rotation of dial 530 in the direction of arrow R1 about axis A within indicia space 583 with respect to closure 520 from a first orientation to a second orientation (e.g., to keep track of a medication schedule for content of bottle 590) by enabling user rotation of handle 566 in the direction of arrow R2 about axis B, cap subassembly 510 may be configured to prevent rotation of dial 530 in the opposite direction of arrow R2 about axis A. For example, as shown, gear assembly 540 may include a ratchet component 542 and base 570 may include a stopper component 572 that may be configured to interact with ratchet component 542 for preventing rotation of gear subassembly 550 in the direction of arrow R2 while enabling rotation of gear subassembly 550 in the direction of arrow R1. For example, as shown, ratchet component 542 may be provided along a portion of gear subassembly 550 (e.g., adjacent a top portion of gear 552) and base 570 may provide stopper component 572 just adjacent ratchet component 542 in the +X direction (e.g., as an extension of a portion of top surface 571 of the base body of base 570), such that a free end of stopper component 572 may enable rotation of ratchet component 542 and, thus, gear 550 and dial 530 in the direction of arrow R1 about axis A and at the same time prevent rotation of ratchet component 542 and, thus, gear 552 and dial 530 in the direction of arrow R2 about axis A (e.g., due to the geometrical relationship between teeth or other suitable features of ratchet component 542 and the free end of stopper component 572). Moreover, interaction of ratchet component 542 and stopper component 572 may provide a user with an audible and/or tactile feedback to user adjustment of the indicia of assembly 500. In some embodiments, stopper component 572 may be tensioned by a suitable amount such that the free end of stopper component 572 may exert a suitable force on ratchet component 542 for even preventing rotation of dial 530 in the direction of arrow R1 about axis A, where such a force may be overcome by an intentional user force on handle 566 but that may not be overcome by any unintentional forces to which cap subassembly 510 may be susceptible during normal use of assembly 500, such that components 542/572 may enable proper rotation of dial 530 in the direction of arrow R1 but only if at least a certain amount of threshold force is applied to gear assembly 540 (e.g., to handle 566).

Additionally or alternatively to being provided with ratchet component and stopper component (e.g., ratchet component 542 and stopper component 572), gear assembly 540 may be configured to have a resting state in which movement of gear subassembly 550 may not translate into motion of gear subassembly 560 (and vice versa) and an active state in which movement of gear subassembly 550 may translate into motion of gear subassembly 560 (and vice versa). For example, as shown in FIG. 10, gear assembly 540 may be in a resting state, whereby a spacing distance (e.g., similar to spacing distance 141) may exist between gear 552 and gear 562 (e.g., along the X-axis and/or along the Z-axis of FIG. 10), such that any rotation of user gear 562 in such a resting state (e.g., about axis B in the direction of arrow R1 or arrow R2) would not be translated into a rotation of dial gear 552. In order to reconfigure gear assembly 540 from such a resting state into an active state, a user may first apply an upward force (e.g., in the +Z direction along axis B) on gear subassembly 560 (e.g., via handle 566), such that gear 562 may be moved upwards by the spacing distance in order to contact gear 552 (e.g., such that teeth of gear 562 may mesh with teeth of gear 552), and then the user may apply a rotation force (e.g., in the direction of arrow R2 about axis B) to user gear subassembly 560 (e.g., via handle 566) for rotating meshed dial gear 552 in the direction of arrow R1 about axis A. This may help prevent unintentional rotation of dial 530 and, thus, unintentional updating of exposed dial indicia 536.

By reducing the thickness of dial 530 while also minimizing the thickness of indicia spacing 583 to only that which may be needed for gear assembly 530, a height of indicia space 583 between top 521 and bottom 579 of assembly 500 may be shorter than a height of indicia space 183 between top 121 and bottom 179 of assembly 100, while a portion of that reduced height may be used to store a portion of a handle 566 (e.g., a free end of handle 566) when in a non-use state.

Figure 11:
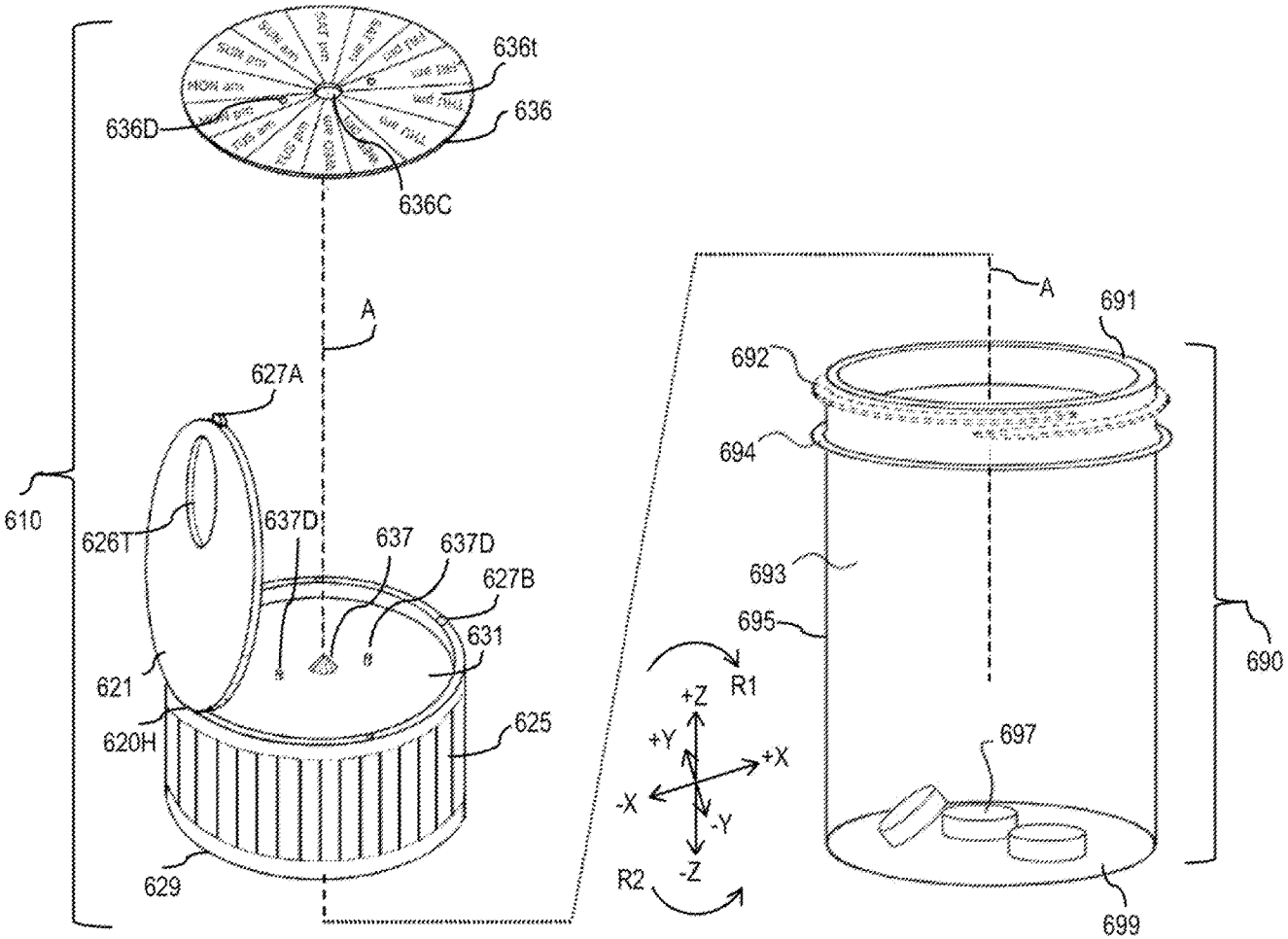
FIG. 11 is an exploded perspective view, similar to FIG. 1, of yet another embodiment of a container assembly.
Figure 12:
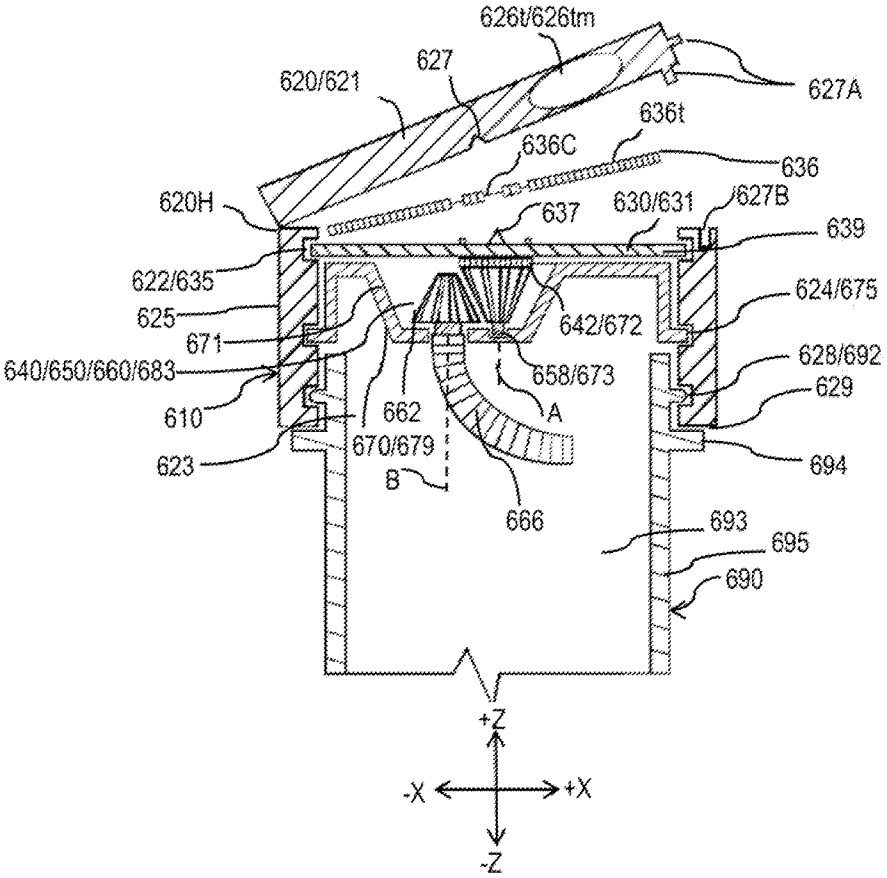
FIG. 12 is a cross-sectional view, similar to FIGS. 6-10, of a portion of the container assembly of FIG. 11.

FIG. 11 and FIG. 12 (Assembly 600)

FIGS. 11 and 12 show another illustrative bottle container assembly 600, which may be similar to assembly 100 of FIGS. 1-6 but may include a movable lid for enabling replacement of a dial or at least of the dial indicia of a dial. Assembly 600 of FIGS. 11 and 12 may include similar components to assembly 100 of FIGS. 1-6, with components of assembly 600 of FIGS. 11 and 12 being labeled with "6xx" reference labels that may correspond to the "1xx" reference labels of the labeled components of assembly 100 of FIGS. 1-6, where differences therebetween may be described below. As shown, assembly 600 may include a bottle 690 and a cap 610 that may be coupled to bottle 690 for forming a closed container that may safely hold content therein. For example, bottle 690 may include a bottle body that may include one or more side walls 695 that may extend from a closed bottom end 699 to an at least partially open top end 691 for defining an interior bottle space 693. Bottle 690 may be configured such that a user may insert content 697 through open end 691 into bottle space 693 (e.g., along the −Z direction) and/or may remove content 697 from bottle space 693 through open end 691 (e.g., along the +Z direction). Bottle 690 may be any suitable container portion that may be configured to hold any suitable content 697 in any suitable way. Bottle 690 may be made of any suitable material or combination of materials and may be of any suitable dimensions.

Cap 610 may be configured to be removably coupled to bottle 690, such that cap 610 may cover open end 691 for preventing a user from accessing bottle space 693 when cap 610 is coupled to bottle 690, and such that cap 610 may not cover at least a portion of open end 691 for enabling a user to access bottle space 693 when cap 610 is not coupled to bottle 690. Assembly 600 may be configured in any suitable way for enabling cap subassembly to be removably coupled to bottle 690. As just one example, bottle 690 may include at least one cap attachment feature 692 and cap 610 may include at least one bottle attachment feature 628, where cap attachment feature 692 and bottle attachment feature 628 may be any suitable combination of reciprocal or otherwise related features that may be configured to interact with each other for removably coupling cap 610 to bottle 690 (e.g., threads, snaps, notches, clips, location or transition fits, etc.). Bottle 690 may also include a lip 694, which may protrude from an exterior surface of body 695 below cap attachment feature 692, where lip 694 may be configured to suspend cap subassembly 610 by at least a certain distance above the closed end. Cap attachment feature 692 and/or lip 694 may ensure a specific relationship between cap 610 and bottle 690 when cap 610 is coupled to bottle 690.

Cap 610 may include a closure 620, a dial 630, a gear assembly 640, and a base 670. Closure 620 of cap 610 may include a closure body that may include one or more side walls 625 that may extend from an at least partially closed top end 621 to an at least partially open bottom end 629 for defining an interior closure space 623. Closure 620 may also include one or more closure indicia passageways 626 through any suitable portions of closure 620 for selectively exposing to a user one or more other portions of cap subassembly 600 (e.g., portions of dial 630, as described below). As shown, closure indicia passageways 626 may include at least one top closure indicia passageway **626*t* that may be provided through the wall of top end 621 of closure 620. As described below, each closure indicia passageway 626 may be a hollow opening through a wall or other portion of closure 620 or may be such an opening that may be covered by or otherwise configured to include a transparent or translucent material or any other suitable object (e.g., a magnifying glass 626*tm*) that may enable communication of information therethrough to a user of assembly 600. Closure 620 may be made of any suitable material or combination of materials and may be of any suitable dimensions. Closure 620 may also include a hinge 620H or any other suitable mechanism that may enable at least a portion of top end 621 of closure 620 to be rotated or otherwise moved away from closure space 623 (e.g., from an X-Y plane to a Y-Z plane of FIG. 11), such that a user may have access to at least a portion of closure space 623 (e.g., in the −Z direction), which may enable the user to replace dial 630 or any dial indicia thereon. Closure 620 may include one or more attachment features 627A at top end 621 for enabling removable coupling of top end 621 with one or more attachment features 627B along a top of a side wall 625 of closure 620**.

Dial 630 of cap 610 may include a dial body that may include one or more side walls that may extend from an at least partially closed top end 631 to an at least partially closed bottom end 639. Unlike dial 230, which may be an at least partially open shape and/or include a side dial indicia, dial 630 may be a relatively thin closed dial (e.g., along the Z-axis) with no side dial indicia, which may reduce the thickness of cap 610. Dial 630 may include any suitable dial indicia 636 that may be positioned on any suitable portions of dial 630 for selective display to a user of assembly 600. As shown, dial indicia 636 may include top dial indicia **636*t* that may be provided on an exterior surface of top end 631 of dial 630, and/or bottom dial indicia (not shown) that may be provided on an exterior surface of bottom end 639. Dial 630 may be configured to fit at least partially within closure space 623, such that dial 630 may be moved within closure space 623 with respect to closure 620 for selectively aligning different dial indicia 636 of dial 630 with a closure indicia passageway 626 of closure 620 and/or a base indicia passageway of base 670 (not shown). Dial 630 may be made of any suitable material or combination of materials and may be of any suitable dimensions. Unlike dial 130, dial 630 may be configured to be coupled (e.g., permanently or removably) to closure 620, such that, for example, closure 620 may prevent dial 630 from moving (e.g., along the Z-axis). For example, dial 630 may include at least one closure attachment feature (e.g., the shape of an exterior surface of side wall(s) 635 of dial 630) and closure 620 may include at least one dial attachment feature 622 (e.g., one or more grooves or female threads protruding from an interior surface of closure 620), where dial 630 may snap into or otherwise fit dial 630 within dial attachment feature 622 for securing dial 630 within closure space 623. Dial attachment feature 622 may be positioned above both base attachment feature 624 (described below) and bottle attachment feature 628 within closure space 623 of closure 620 such that dial 630 and base 670 may be coupled to closure 620 while still enabling bottle attachment feature 628 to removably couple closure 620 to bottle 690. In some embodiments, an upper portion of attachment feature 628 may not be provided such that dial 630 may be easily removed from closure space 623 (e.g., in the +Z direction by a user when top 621 provides access to closure space 623), which may enable a user to replace dial 630 and/or at least replace indicia on all sides of dial 630**.

Base 670 of cap 610 may include a base body that may include one or more side walls 675 that may extend from an at least partially closed top end 671 to an at least partially closed bottom end 679. Base 670 may be configured to be coupled (e.g., permanently or removably) to closure 620, such that, for example, base 670 and closure 620 may together define at least a portion of an indicia space 683 within which dial 630 may be positioned. For example, base 670 may include at least one closure attachment feature (e.g., the shape of an exterior surface of side wall(s) 675 of base 670) and closure 620 may include at least one base attachment feature 624 (e.g., one or more grooves or female threads protruding from an interior surface of closure 620), where base 670 may snap into or otherwise fit base 670 within base attachment feature 624 for securing base 670 within closure space 623, which may thereby define a reduced indicia space 683 between closure 620 and base 670. Base attachment feature 624 may be positioned above bottle attachment feature 628 within closure space 623 of closure 620 such that base 670 may be coupled to closure 620 while still enabling bottle attachment feature 628 to removably couple closure 620 to bottle 690. While closure space 623 may be defined by the interior surface(s) of side wall(s) 625, top end 621, and bottom end 629 of closure 620, indicia space 683 may be defined by the interior surface(s) of side wall(s) 625 and top end 621 of closure 620 as well as by base 670, such that indicia space 683 may be a portion of closure space 623. Thus, base 670 may be configured to fit at least partially within closure space 623, such that base 670 may define at least a portion of the bottom of indicia space 683. Base 670 may be made of any suitable material or combination of materials and may be of any suitable dimensions. Dial 630 may be at least partially positioned within indicia space 683 when base 670 is coupled to closure 620. Base 670 may have less material than base 270 or base 370, and a thickness of base 670 (e.g., along the Z-axis) may be substantially constant while portions of base 670 may run adjacently along bottom 639 of dial 630 (e.g., to support dial 630).

Gear assembly 640 of cap 610 may be at least partially positioned within indicia space 683 along with dial 630, and gear assembly 640 may be configured to selectively move dial 630 within indicia space 683 with respect to closure 620 for selectively aligning different dial indicia 636 with a closure indicia passageway 626 of closure 620. Gear assembly 640 may include one or more gears that may be configured to translate a user motion that may be applied to a first portion of gear assembly 640 into movement of dial 630 with indicia space 683 (e.g., rotation of dial 630 about an axis A along a Z-axis). As shown, gear assembly 640 may include an upper or dial gear subassembly 650 and a lower or user gear subassembly 660. Dial gear subassembly 650 may include an upper or dial cogwheel or gear 652 and, in some embodiments, an upper or dial gear shaft 658 that may extend away from gear 652 along an axis of rotation of gear 652 (e.g., axis A along a Z-axis). User gear subassembly 660 may include a lower or user cogwheel or gear 662 and, in some embodiments, a lower or user gear shaft 668 that may extend away from gear 662 along an axis of rotation of gear 662 (e.g., axis B along a Z-axis that may be parallel to axis A). User gear subassembly 660 may also include a user handle 666 that may be coupled to a portion of gear 662 (e.g., at an end of gear shaft 668), such that a user may apply a user force or motion to handle 666 for rotating gear 662. Gear assembly 640 may be configured such that rotation of gear 662 may be configured to rotate or otherwise translate gear 652, which may be configured to rotate or otherwise translate dial 630 with respect to closure 620 within indicia space 683. For example, as shown, gear 662 may include teeth or cogs or any other suitable mechanical feature that may mesh with teeth or cogs or any other suitable mechanical feature of gear 652 to transmit torque therebetween within gear assembly 640 (e.g., as a transmission or gearbox).

Base 670 may be configured to support at least a portion of gear assembly 640 and/or dial 630 within indicia space 683 when base 670 is coupled to closure 620. For example, as shown, at least a portion of user gear subassembly 660 (e.g., a bottom portion of gear 662) may be configured to rest against base 670 (e.g., against an exterior surface of top wall 671 of base 670). A user gear shaft opening 677 may be provided through base 670 (e.g., between top wall 671 and bottom wall 679) for enabling at least a portion of user gear shaft 668 and/or user handle 666 to extend therethrough from indicia space 683 to at least a portion of closure space 623 and/or bottle space 693 or for at least enabling a portion of gear subassembly 660 to be accessible therethrough, such that a portion of gear assembly 640 may be accessible to a user when cap 610 is not coupled to bottle 690 (e.g., when a user unscrews cap 610 from bottle 690 for accessing contents 697). Such accessibility to a portion of gear subassembly 660 by a user external to indicia space 683 (e.g., via user gear shaft opening 677 of base 670) may enable a user of assembly 600 to apply a user force or motion to handle 666 for rotating gear 662. Alternatively or additionally, in some embodiments, user gear shaft opening 677 of base 670 may at least partially define an axis of rotation of user gear 662 and/or may otherwise limit at least a portion of a path along which at least a portion of user gear subassembly 660 may travel (e.g., by preventing or limiting movement of gear subassembly 660 along the X-axis and/or along the Y-axis within indicia space 683). For example, as shown, user gear 662 may be configured to rotate about an axis B, and gear shaft 668 may extend away from gear 662 along axis B, such that gear shaft opening 677 may align with axis B. Additionally or alternatively, as shown, at least a portion of dial gear subassembly 650 (e.g., a top portion of gear 652) may be coupled to dial 630 (e.g., to bottom wall 639 of dial 630), such that movement of gear subassembly 650 may provide movement of dial 630 (e.g., rotational movement about axis A). In some embodiments, a dial gear shaft opening 673 may be provided through at least a portion of base 670 (e.g., through top wall 671), where opening 673 may at least partially define an axis of rotation of dial gear 652 and/or may otherwise limit at least a portion of a path along which at least a portion of dial gear subassembly 650 may travel (e.g., by preventing or limiting movement of gear subassembly 650 along the X-axis and/or along the Y-axis within indicia space 683). For example, as shown, dial gear 652 may be configured to rotate about an axis A, and gear shaft 658 may extend away from gear 652 along axis A, such that gear shaft opening 673 may align with axis A. However, in some embodiments, gear shaft opening 673 and/or gear shaft 658 may not be necessary and other features of assembly 600 may define axis A about which gear 652 may rotate. For example, the positioning of base 670, gear subassembly 660, and dial 630 within indicia space 683 may limit the manner in which gear subassembly 650 may move within indicia space 683 (e.g., only to movement about axis A). In some embodiments, as shown in FIG. 12, an interior surface of top end 621 of closure 620 may include a dial movement feature 627 and an exterior surface of top end 631 of dial 630 may include a closure movement feature 637, where such features 627 and 637 may interact with one another to at least partially define an axis of rotation of dial 630 with respect to closure 620 (e.g., axis A) or otherwise aid or limit such movement (e.g., by preventing or limiting movement of dial 630 along the X-axis and/or along the Y-axis within indicia space 683), for example, where feature 637 may be a nub that may extend into a cut out or notch 627. In some embodiments, the thickness of the wall of top end 631 of dial 630 along the Z-axis combined with the thickness of gear assembly 640 along the Z-axis may be substantially equal to or slightly less than a thickness of indicia space 683 along the Z-axis, such that dial 630 and/or gear assembly 640 may be prevented or limited with respect to movement along the Z-axis. In some embodiments, dial indicia 636 may be replaceable on dial 630 (e.g., on top 631) when top 621 of closure 620 provides access to dial 630. As shown in FIGS. 11 and 12, such dial indicia 636 may include a feature 636C that may surround or otherwise interact with feature 637 of dial 630 (e.g., along axis A), while such dial indicia 636 may also include at least one feature 636D that may surround or otherwise interact with feature 637D of dial 630 (e.g., offset from axis A), which may enable proper orientation of indicia 636 with dial 630 when be positioned thereon by a user.

As just one example of use, a user may interact with handle 666 of user gear subassembly 660, as may be accessible to a user through opening 677 of base 670, for rotating gear shaft 668 and/or gear 662 in the direction of arrow R2 about axis B, which may in turn rotate gear 652 of dial subassembly 650 in the direction of arrow R1 about axis A, which may in turn rotate dial 630 in the direction of arrow R1 about axis A. Such rotation of dial 630 in the direction of arrow R1 about axis A within indicia space 683 with respect to closure 620 may alter the particular portion of dial 630 and, thus, the particular portion of dial indicia 636 that may be aligned with a particular closure indicia passageway 626, which may alter what information may be provided to a user of assembly 600 by that particular portion of dial indicia 636. For example, as shown in FIG. 12, when dial 630 is at a first particular orientation with respect to closure 620 and base 670 within indicia space 683, a first indication of top dial indicia **636*t* may be aligned with and visible through indicia passageway 626*t*. However, when dial 630 is rotated in the direction of arrow R1 about axis A within indicia space 683 with respect to closure 620 from such a first orientation to a second orientation, the particular portion of dial 630 and, thus, the particular portion of dial indicia 636 that may be aligned with such indicia passageway 626 may be altered. As shown, handle 666 may include a flexible arm that may be configured to bend or flex in any suitable direction and/or to any suitable shape (e.g., with respect to the Z-axis) such that handle 666 may extend up towards or at least parallel to base 670 (e.g., as shown in FIG. 10) and then may be bent to a second elongated state (e.g., with respect to the Z-axis), which may enable handle 666 to extend away from base 670 for easier use by a user and then bend towards or along base 670 so as not to extend (too far) out away from base 670 and/or indicia space 683 so as to interfere with content 697 of bottle 690 or a factory protective seal that may be initially provided by bottle 690 (e.g., across top 691**).

While cap subassembly 610 may be configured to enable rotation of dial 630 in the direction of arrow R1 about axis A within indicia space 683 with respect to closure 620 from a first orientation to a second orientation (e.g., to keep track of a medication schedule for content of bottle 690) by enabling user rotation of handle 666 in the direction of arrow R2 about axis B, cap subassembly 610 may be configured to prevent rotation of dial 630 in the opposite direction of arrow R2 about axis A. For example, as shown, gear assembly 640 may include a ratchet component 642 and base 670 may include a stopper component 672 that may be configured to interact with ratchet component 642 for preventing rotation of gear subassembly 650 in the direction of arrow R2 while enabling rotation of gear subassembly 650 in the direction of arrow R1. For example, as shown, ratchet component 642 may be provided along a portion of gear subassembly 650 (e.g., adjacent a top portion of gear 652) and base 670 may provide stopper component 672 just adjacent ratchet component 642 in the +X direction (e.g., as an extension of a portion of top surface 671 of the base body of base 670), such that a free end of stopper component 672 may enable rotation of ratchet component 642 and, thus, gear 650 and dial 630 in the direction of arrow R1 about axis A and at the same time prevent rotation of ratchet component 642 and, thus, gear 652 and dial 630 in the direction of arrow R2 about axis A (e.g., due to the geometrical relationship between teeth or other suitable features of ratchet component 642 and the free end of stopper component 672). Moreover, interaction of ratchet component 642 and stopper component 672 may provide a user with an audible and/or tactile feedback to user adjustment of the indicia of assembly 600. In some embodiments, stopper component 672 may be tensioned by a suitable amount such that the free end of stopper component 672 may exert a suitable force on ratchet component 642 for even preventing rotation of dial 630 in the direction of arrow R1 about axis A, where such a force may be overcome by an intentional user force on handle 666 but that may not be overcome by any unintentional forces to which cap subassembly 610 may be susceptible during normal use of assembly 600, such that components 642/672 may enable proper rotation of dial 630 in the direction of arrow R1 but only if at least a certain amount of threshold force is applied to gear assembly 640 (e.g., to handle 666).

Additionally or alternatively to being provided with ratchet component and stopper component (e.g., ratchet component 642 and stopper component 672), gear assembly 640 may be configured to have a resting state in which movement of gear subassembly 650 may not translate into motion of gear subassembly 660 (and vice versa) and an active state in which movement of gear subassembly 650 may translate into motion of gear subassembly 660 (and vice versa). For example, as shown in FIG. 12, gear assembly 640 may be in a resting state, whereby a spacing distance (e.g., similar to spacing distance 141) may exist between gear 652 and gear 662 (e.g., along the X-axis and/or along the Z-axis of FIG. 12), such that any rotation of user gear 662 in such a resting state (e.g., about axis B in the direction of arrow R1 or arrow R2) would not be translated into a rotation of dial gear 652. In order to reconfigure gear assembly 640 from such a resting state into an active state, a user may first apply an upward force (e.g., in the +Z direction along axis B) on gear subassembly 660 (e.g., via handle 666), such that gear 662 may be moved upwards by the spacing distance in order to contact gear 652 (e.g., such that teeth of gear 662 may mesh with teeth of gear 652), and then the user may apply a rotation force (e.g., in the direction of arrow R2 about axis B) to user gear subassembly 660 (e.g., via handle 666) for rotating meshed dial gear 652 in the direction of arrow R1 about axis A. This may help prevent unintentional rotation of dial 630 and, thus, unintentional updating of exposed dial indicia 636.

By reducing the thickness of dial 630 while also minimizing the thickness of indicia spacing 683 to only that which may be needed for gear assembly 630, a height of indicia space 683 between top 621 and bottom 679 of assembly 600 may be shorter than a height of indicia space 183 between top 121 and bottom 179 of assembly 100, while a portion of that reduced height may be used to store a portion of a handle 666 (e.g., a free end of handle 666) when in a non-use state. Additionally or alternatively, by enabling user access to dial 630 (e.g., via a movable top end 621 of closure 620, a user may interchange dials 630 or indicia 636 thereon for using assembly 600 for different purposes with different appropriate adjustable indicia.

Figure 13:
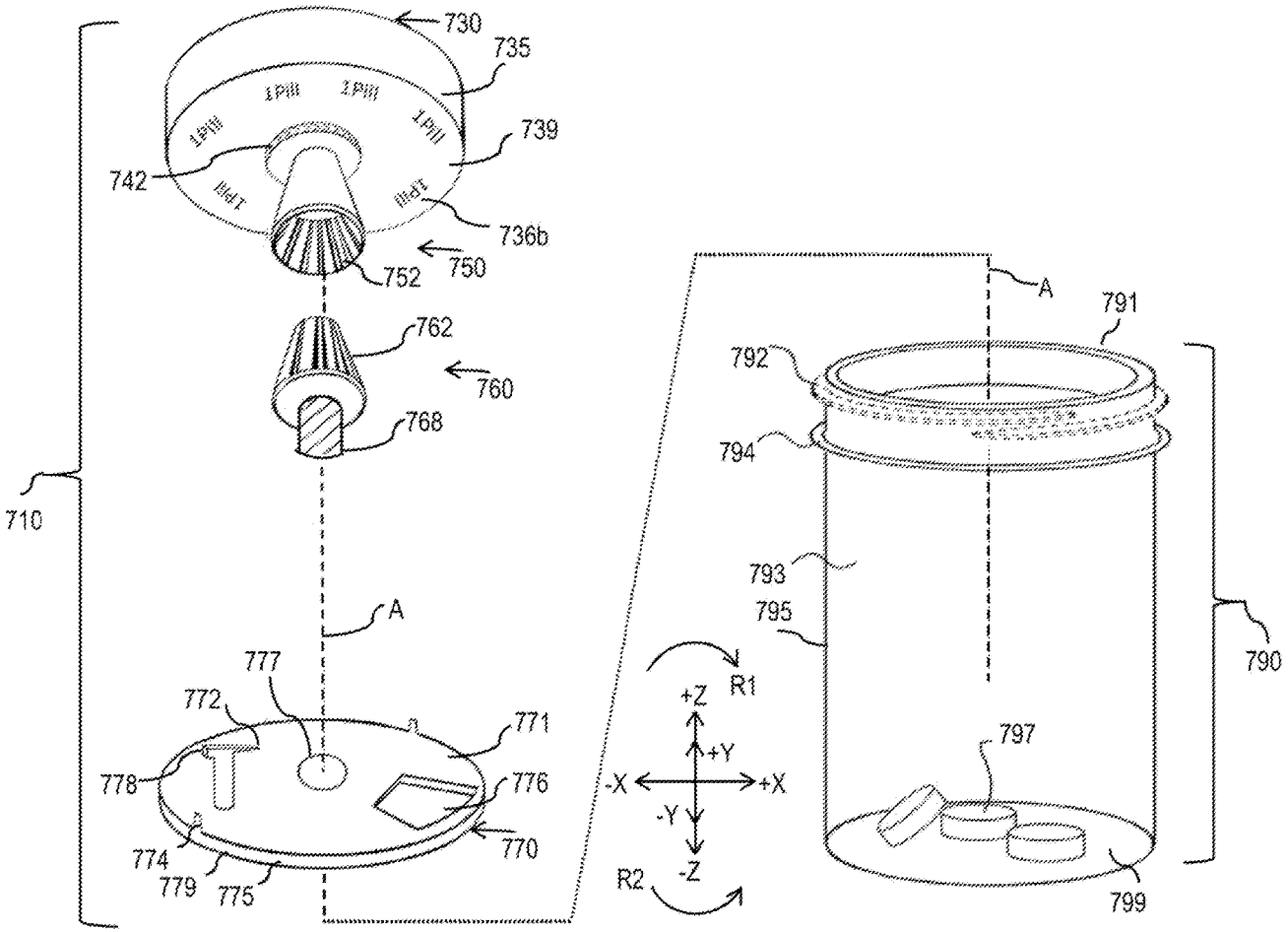
FIG. 13 is an exploded perspective view, similar to FIGS. 1 and 11, of yet another embodiment of a container assembly.
Figure 14:
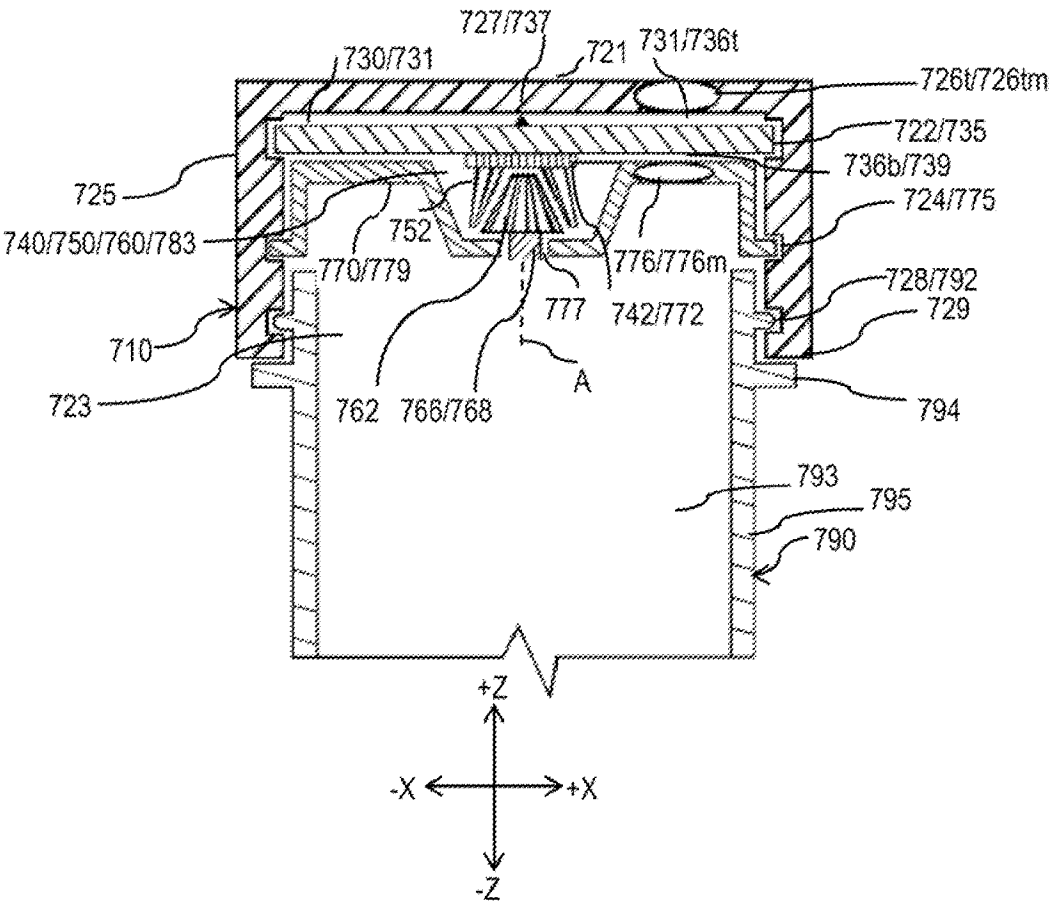
FIG. 14 is a cross-sectional view, similar to FIGS. 6-10 and 12, of a portion of the container assembly of FIG. 13.

FIG. 13 and FIG. 14 (Assembly 700)

FIGS. 13 and 14 show another illustrative bottle container assembly 700, which may be similar to assembly 100 of FIGS. 1-6 but may include axially aligned gear subassemblies. Assembly 700 of FIGS. 13 and 14 may include similar components to assembly 100 of FIGS. 1-6, with components of assembly 700 of FIGS. 13 and 14 being labeled with "7xx" reference labels that may correspond to the "1xx" reference labels of the labeled components of assembly 100 of FIGS. 1-6, where differences therebetween may be described below. As shown, assembly 700 may include a bottle 790 and a cap 710 that may be coupled to bottle 790 for forming a closed container that may safely hold content therein. For example, bottle 790 may include a bottle body that may include one or more side walls 795 that may extend from a closed bottom end 799 to an at least partially open top end 791 for defining an interior bottle space 793. Bottle 790 may be configured such that a user may insert content 797 through open end 791 into bottle space 793 (e.g., along the −Z direction) and/or may remove content 797 from bottle space 793 through open end 791 (e.g., along the +Z direction). Bottle 790 may be any suitable container portion that may be configured to hold any suitable content 797 in any suitable way. Bottle 790 may be made of any suitable material or combination of materials and may be of any suitable dimensions.

Cap 710 may be configured to be removably coupled to bottle 790, such that cap 710 may cover open end 791 for preventing a user from accessing bottle space 793 when cap 710 is coupled to bottle 790, and such that cap 710 may not cover at least a portion of open end 791 for enabling a user to access bottle space 793 when cap 710 is not coupled to bottle 790. Assembly 700 may be configured in any suitable way for enabling cap subassembly to be removably coupled to bottle 790. As just one example, bottle 790 may include at least one cap attachment feature 792 and cap 710 may include at least one bottle attachment feature 728, where cap attachment feature 792 and bottle attachment feature 728 may be any suitable combination of reciprocal or otherwise related features that may be configured to interact with each other for removably coupling cap 710 to bottle 790 (e.g., threads, snaps, notches, clips, location or transition fits, etc.). Bottle 790 may also include a lip 794, which may protrude from an exterior surface of body 795 below cap attachment feature 792, where lip 794 may be configured to suspend cap subassembly 710 by at least a certain distance above the closed end. Cap attachment feature 792 and/or lip 794 may ensure a specific relationship between cap 710 and bottle 790 when cap 710 is coupled to bottle 790.

Cap 710 may include a closure 720, a dial 730, a gear assembly 740, and a base 770. Closure 720 of cap 710 may include a closure body that may include one or more side walls 725 that may extend from an at least partially closed top end 721 to an at least partially open bottom end 729 for defining an interior closure space 723. Closure 720 may also include one or more closure indicia passageways 726 through any suitable portions of closure 720 for selectively exposing to a user one or more other portions of cap subassembly 700 (e.g., portions of dial 730, as described below). As shown, closure indicia passageways 726 may include at least one top closure indicia passageway **726*t* that may be provided through the wall of top end 721 of closure 720. As described below, each closure indicia passageway 726 may be a hollow opening through a wall or other portion of closure 720 or may be such an opening that may be covered by or otherwise configured to include a transparent or translucent material or any other suitable object (e.g., a magnifying glass 726*tm*) that may enable communication of information therethrough to a user of assembly 700. Closure 720** may be made of any suitable material or combination of materials and may be of any suitable dimensions.

Dial 730 of cap 710 may include a dial body that may include one or more side walls that may extend from an at least partially closed top end 731 to an at least partially closed bottom end 739. Unlike dial 230, which may be an at least partially open shape and/or include a side dial indicia, dial 730 may be a relatively thin closed dial (e.g., along the Z-axis) with no side dial indicia, which may reduce the thickness of cap 710. Dial 730 may include any suitable dial indicia 736 that may be positioned on any suitable portions of dial 730 for selective display to a user of assembly 700. As shown, dial indicia 736 may include top dial indicia **736*t* that may be provided on an exterior surface of top end 731 of dial 730, and/or bottom dial indicia 736*b* that may be provided on an exterior surface of bottom end 739. Dial 730 may be configured to fit at least partially within closure space 723, such that dial 730 may be moved within closure space 723 with respect to closure 720 for selectively aligning different dial indicia 736 of dial 730 with a closure indicia passageway 726 of closure 720 and/or a base indicia passageway 776 of base 770. Dial 730 may be made of any suitable material or combination of materials and may be of any suitable dimensions. Unlike dial 130, dial 730 may be configured to be coupled (e.g., permanently or removably) to closure 720, such that, for example, closure 720 may prevent dial 730 from moving (e.g., along the Z-axis). For example, dial 730 may include at least one closure attachment feature (e.g., the shape of an exterior surface of side wall(s) 735 of dial 730) and closure 720 may include at least one dial attachment feature 722 (e.g., one or more grooves or female threads protruding from an interior surface of closure 720), where dial 730 may snap into or otherwise fit dial 730 within dial attachment feature 722 for securing dial 730 within closure space 723. Dial attachment feature 722 may be positioned above both base attachment feature 724 (described below) and bottle attachment feature 728 within closure space 723 of closure 720 such that dial 730 and base 770 may be coupled to closure 720 while still enabling bottle attachment feature 728 to removably couple closure 720 to bottle 790**.

Base 770 of cap 710 may include a base body that may include one or more side walls 775 that may extend from an at least partially closed top end 771 to an at least partially closed bottom end 779. Base 770 may be configured to be coupled (e.g., permanently or removably) to closure 720, such that, for example, base 770 and closure 720 may together define at least a portion of an indicia space 783 within which dial 730 may be positioned. For example, base 770 may include at least one closure attachment feature (e.g., the shape of an exterior surface of side wall(s) 775 of base 770) and closure 720 may include at least one base attachment feature 724 (e.g., one or more grooves or female threads protruding from an interior surface of closure 720), where base 770 may snap into or otherwise fit base 770 within base attachment feature 724 for securing base 770 within closure space 723, which may thereby define a reduced indicia space 783 between closure 720 and base 770. Base attachment feature 724 may be positioned above bottle attachment feature 728 within closure space 723 of closure 720 such that base 770 may be coupled to closure 720 while still enabling bottle attachment feature 728 to removably couple closure 720 to bottle 790. While closure space 723 may be defined by the interior surface(s) of side wall(s) 725, top end 721, and bottom end 729 of closure 720, indicia space 783 may be defined by the interior surface(s) of side wall(s) 725 and top end 721 of closure 720 as well as by base 770, such that indicia space 783 may be a portion of closure space 723. Thus, base 770 may be configured to fit at least partially within closure space 723, such that base 770 may define at least a portion of the bottom of indicia space 783. Base 770 may be made of any suitable material or combination of materials and may be of any suitable dimensions. Dial 730 may be at least partially positioned within indicia space 783 when base 770 is coupled to closure 720. Base 770 may have less material than base 270 or base 370, and a thickness of base 770 (e.g., along the Z-axis) may be substantially constant while portions of base 770 may run adjacently along bottom 739 of dial 730 (e.g., to support dial 730).

Gear assembly 740 of cap 710 may be at least partially positioned within indicia space 783 along with dial 730, and gear assembly 740 may be configured to selectively move dial 730 within indicia space 783 with respect to closure 720 for selectively aligning different dial indicia 736 with a closure indicia passageway 726 of closure 720. Gear assembly 740 may include one or more gears that may be configured to translate a user motion that may be applied to a first portion of gear assembly 740 into movement of dial 730 with indicia space 783 (e.g., rotation of dial 730 about an axis A along a Z-axis). As shown, gear assembly 740 may include an upper or dial gear subassembly 750 and a lower or user gear subassembly 760. Dial gear subassembly 750 may include an upper or dial cogwheel or gear 752 and, in some embodiments, an upper or dial gear shaft (not shown) that may extend away from gear 752 along an axis of rotation of gear 752 (e.g., axis A along a Z-axis). User gear subassembly 760 may include a lower or user cogwheel or gear 762 and, in some embodiments, a lower or user gear shaft 768 that may extend away from gear 762 along an axis of rotation of gear 762 (e.g., axis A). User gear subassembly 760 may also include a user handle 766 that may be coupled to a portion of gear 762 (e.g., at an end of gear shaft 768), such that a user may apply a user force or motion to handle 766 for rotating gear 762. Gear assembly 740 may be configured such that rotation of gear 762 may be configured to rotate or otherwise translate gear 752, which may be configured to rotate or otherwise translate dial 730 with respect to closure 720 within indicia space 783. For example, as shown, gear 762 may include teeth or cogs or any other suitable mechanical feature of gear 762 (e.g., on a cylindrical or conical or any other suitable shaped exterior surface of gear 762, such that teeth of gear 762 may extend away from axis A of gear 762 towards gear 752 (e.g., along the X-axis)) that may mesh with teeth or cogs or any other suitable mechanical feature of gear 752 (e.g., on a cylindrical or conical or any other suitable shaped interior surface of gear 752, such that teeth of gear 752 may extend away towards axis A of gear 752 and towards gear 762 (e.g., along the X-axis)) to transmit torque therebetween within gear assembly 740 (e.g., as a transmission or gearbox). Gear 752 may be cup shaped for receiving at least a portion of gear 762 therein (e.g., in a nesting fashion).

Base 770 may be configured to support at least a portion of gear assembly 740 and/or dial 730 within indicia space 783 when base 770 is coupled to closure 720. For example, as shown, at least a portion of user gear subassembly 760 (e.g., a bottom portion of gear 762) may be configured to rest against base 770 (e.g., against an exterior surface of top wall 771 of base 770). A user gear shaft opening 777 may be provided through base 770 (e.g., between top wall 771 and bottom wall 779) for enabling at least a portion of user gear shaft 768 and/or user handle 766 to extend therethrough from indicia space 783 to at least a portion of closure space 723 and/or bottle space 793 or for at least enabling a portion of gear subassembly 760 to be accessible therethrough, such that a portion of gear assembly 740 may be accessible to a user when cap 710 is not coupled to bottle 790 (e.g., when a user unscrews cap 710 from bottle 790 for accessing contents 797). Such accessibility to a portion of gear subassembly 760 by a user external to indicia space 783 (e.g., via user gear shaft opening 777 of base 770) may enable a user of assembly 700 to apply a user force or motion to handle 766 for rotating gear 762. Alternatively or additionally, in some embodiments, user gear shaft opening 777 of base 770 may at least partially define an axis of rotation of user gear 762 and/or may otherwise limit at least a portion of a path along which at least a portion of user gear subassembly 760 may travel (e.g., by preventing or limiting movement of gear subassembly 760 along the X-axis and/or along the Y-axis within indicia space 783). For example, as shown, user gear 762 may be configured to rotate about an axis A, and gear shaft 768 may extend away from gear 762 along axis A, such that gear shaft opening 777 may align with axis A. Additionally or alternatively, as shown, at least a portion of dial gear subassembly 750 (e.g., a top portion of gear 752) may be coupled to dial 730 (e.g., to bottom wall 739 of dial 730), such that movement of gear subassembly 750 may provide movement of dial 730 (e.g., rotational movement about axis A). In some embodiments, the positioning of base 770, gear subassembly 760, and dial 730 within indicia space 783 may limit the manner in which gear subassembly 750 may move within indicia space 783 (e.g., only to movement about axis A). In some embodiments, as shown in FIG. 14, an interior surface of top end 721 of closure 720 may include a dial movement feature 727 and an exterior surface of top end 731 of dial 730 may include a closure movement feature 737, where such features 727 and 737 may interact with one another to at least partially define an axis of rotation of dial 730 with respect to closure 720 (e.g., axis A) or otherwise aid or limit such movement (e.g., by preventing or limiting movement of dial 730 along the X-axis and/or along the Y-axis within indicia space 783), for example, where feature 737 may be a nub that may extend into a cut out or notch 727. In some embodiments, the thickness of the wall of top end 731 of dial 730 along the Z-axis combined with the thickness of gear assembly 740 along the Z-axis may be substantially equal to or slightly less than a thickness of indicia space 783 along the Z-axis, such that dial 730 and/or gear assembly 740 may be prevented or limited with respect to movement along the Z-axis.

As just one example of use, a user may interact with handle 766 of user gear subassembly 760, as may be accessible to a user through opening 777 of base 770, for rotating gear shaft 768 and/or gear 762 in the direction of arrow R1 about axis A, which may in turn rotate gear 752 of dial subassembly 750 in the direction of arrow R1 about axis A, which may in turn rotate dial 730 in the direction of arrow R1 about axis A. Such rotation of dial 730 in the direction of arrow R1 about axis A within indicia space 783 with respect to closure 720 may alter the particular portion of dial 730 and, thus, the particular portion of dial indicia 736 that may be aligned with a particular closure indicia passageway 726, which may alter what information may be provided to a user of assembly 700 by that particular portion of dial indicia 736. For example, as shown in FIG. 14, when dial 730 is at a first particular orientation with respect to closure 720 and base 770 within indicia space 783, a first indication of top dial indicia 736*t* may be aligned with and visible through indicia passageway 726*t* and a first indication of bottom dial indicia 736*b* may be aligned with and visible through indicia passageway 776 (e.g., 776*m*). However, when dial 730 is rotated in the direction of arrow R1 about axis A within indicia space 783 with respect to closure 720 from such a first orientation to a second orientation, the particular portion of dial 730 and, thus, the particular portion of dial indicia 736 that may be aligned with such indicia passageway 726/776 may be altered. As shown, handle 766 may not extend beyond base 770 (e.g., in the −Z direction), but instead may include a friction pad or other suitable feature at its end within opening 777 such that a user may grip handle 766 (e.g., with the tip of a user finger), while handle 766 does not take up any real estate of assembly 700 outside of indicia space 783, which may prevent handle 766 from interfering with content 797 of bottle 790 or a factory protective seal that may be initially provided by bottle 790 (e.g., across top 791).

While cap subassembly 710 may be configured to enable rotation of dial 730 in the direction of arrow R1 about axis A within indicia space 783 with respect to closure 720 from a first orientation to a second orientation (e.g., to keep track of a medication schedule for content of bottle 790) by enabling user rotation of handle 766 in the direction of arrow R1 about axis A, cap subassembly 710 may be configured to prevent rotation of dial 730 in the opposite direction of arrow R2 about axis A. For example, as shown, gear assembly 740 may include a ratchet component 742 and base 770 may include a stopper component 772 that may be configured to interact with ratchet component 742 for preventing rotation of gear subassembly 750 in the direction of arrow R2 while enabling rotation of gear subassembly 750 in the direction of arrow R1. For example, as shown, ratchet component 742 may be provided along a portion of gear subassembly 750 (e.g., adjacent a top portion of gear 752) and base 770 may provide stopper component 772 just adjacent ratchet component 742 in the +X direction (e.g., as an extension of a portion of top surface 771 of the base body of base 770), such that a free end of stopper component 772 may enable rotation of ratchet component 742 and, thus, gear 750 and dial 730 in the direction of arrow R1 about axis A and at the same time prevent rotation of ratchet component 742 and, thus, gear 752 and dial 730 in the direction of arrow R2 about axis A (e.g., due to the geometrical relationship between teeth or other suitable features of ratchet component 742 and the free end of stopper component 772). Moreover, interaction of ratchet component 742 and stopper component 772 may provide a user with an audible and/or tactile feedback to user adjustment of the indicia of assembly 700. In some embodiments, stopper component 772 may be tensioned by a suitable amount such that the free end of stopper component 772 may exert a suitable force on ratchet component 742 for even preventing rotation of dial 730 in the direction of arrow R1 about axis A, where such a force may be overcome by an intentional user force on handle 766 but that may not be overcome by any unintentional forces to which cap subassembly 710 may be susceptible during normal use of assembly 700, such that components 742/772 may enable proper rotation of dial 730 in the direction of arrow R1 but only if at least a certain amount of threshold force is applied to gear assembly 740 (e.g., to handle 766).

Additionally or alternatively to being provided with ratchet component and stopper component (e.g., ratchet component 742 and stopper component 772), gear assembly 740 may be configured to have a resting state in which movement of gear subassembly 750 may not translate into motion of gear subassembly 760 (and vice versa) and an active state in which movement of gear subassembly 750 may translate into motion of gear subassembly 760 (and vice versa). For example, as shown in FIG. 14, gear assembly 740 may be in a resting state, whereby a spacing distance (e.g., similar to spacing distance 141) may exist between gear 752 and gear 762 (e.g., along the X-axis and/or along the Z-axis of FIG. 14), such that any rotation of user gear 762 in such a resting state (e.g., about axis A in the direction of arrow R1 or arrow R2) would not be translated into a rotation of dial gear 752. In order to reconfigure gear assembly 740 from such a resting state into an active state, a user may first apply an upward force (e.g., in the +Z direction along axis A) on gear subassembly 760 (e.g., via handle 766), such that gear 762 may be moved upwards by the spacing distance in order to contact gear 752 (e.g., such that teeth of gear 762 may mesh with teeth of gear 752), and then the user may apply a rotation force (e.g., in the direction of arrow R1 about axis A) to user gear subassembly 760 (e.g., via handle 766) for rotating meshed dial gear 752 in the direction of arrow R1 about axis A. This may help prevent unintentional rotation of dial 730 and, thus, unintentional updating of exposed dial indicia 736.

By reducing the thickness of dial 730 while also minimizing the thickness of indicia spacing 783 to only that which may be needed for gear assembly 730, a height of indicia space 783 between top 721 and bottom 779 of assembly 700 may be shorter than a height of indicia space 183 between top 121 and bottom 179 of assembly 100. Additionally or alternatively, by nesting a user gear subassembly 760 within a dial gear subassembly 750 (or vice versa), such as within an X-Y plane, may reduce a width of at least a portion of an indicia space 783 (e.g., along the X-axis and/or along the Y-axis).

Figure 15:
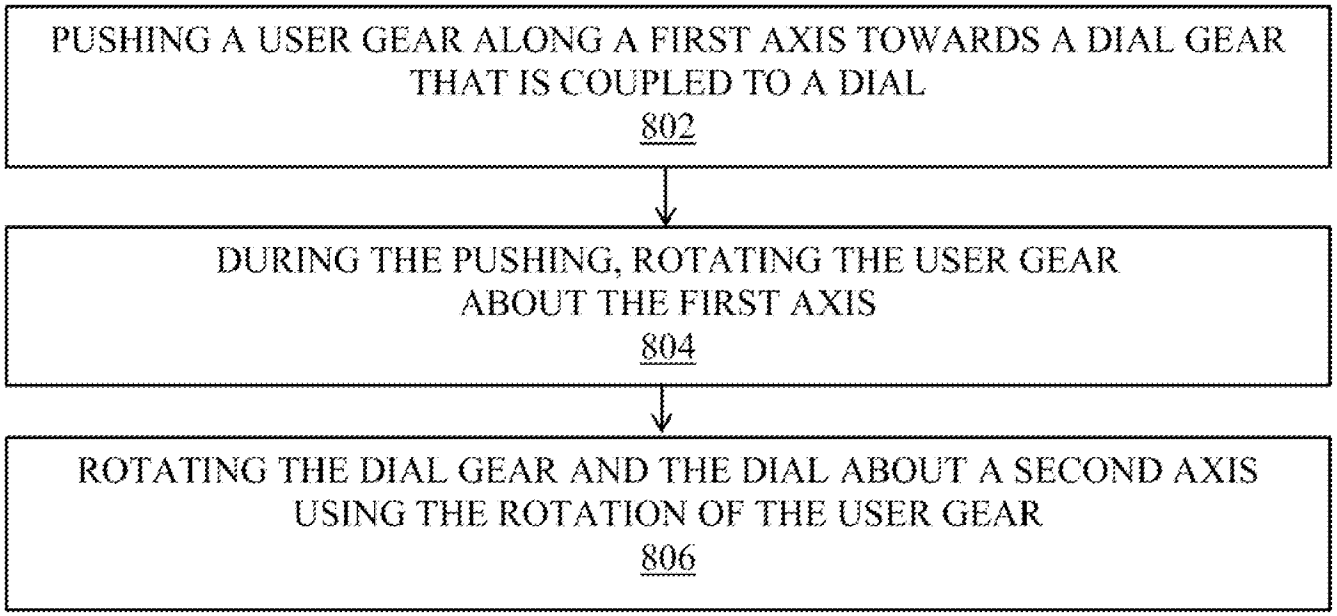
FIG. 15 is a flowchart of an illustrative process for changing the portion of indicia on a dial within a bottle cap that is visible to a user through a passageway in the bottle cap.

FIG. 15 (Process 800)

FIG. 15 is a flowchart of an illustrative process 800 for changing the portion of indicia on a dial within a bottle cap that is visible to a user through a passageway in the bottle cap. At step 802, process 800 may include pushing a user gear along a first axis towards a dial gear that is coupled to the dial. For example, as described with respect to any one of assemblies 100-700, a user gear 162-762 may be pushed towards a dial gear 152-752 that is coupled to a dial 130-730 for eliminating a spacing distance (e.g., distance 141) between the two gears. Next, at step 804, during the pushing of step 802, process 800 may include rotating the user gear about the first axis. For example, as described with respect to any one of assemblies 100-700, a user gear 162-762 may be rotated when such a spacing distance has been eliminated (e.g., when teeth of the user gear are meshed with teeth of the dial gear). Then, at step 806, process 800 may include rotating the dial gear and the dial about a second axis using the rotation of the user gear. For example, as described with respect to any one of assemblies 100-700, rotation of a user gear 162-762 may rotate a dial gear 152-752 and a dial 130-730 coupled thereto. In some embodiments, the first axis of the pushing of step 802 and of the rotating of step 804 may be the same as the second axis of the rotating of step 806 (e.g., axis A of assembly 700 of FIGS. 13 and 14). In other embodiments, the first axis of the pushing of step 802 and of the rotating of step 804 may be different than the second axis of the rotating of step 806 (e.g., axis B versus axis A of any one of assemblies 100-600 of FIGS. 1-12).

It is understood that the steps shown in process 800 of FIG. 15 are merely illustrative and that existing steps may be modified or omitted, additional steps may be added, and the order of certain steps may be altered.

Further Applications of Described Concepts

While there have been described adjustable indicators for containers and methods for using and making the same, it is to be understood that many changes may be made therein without departing from the spirit and scope of the subject matter described herein in any way. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. It is also to be understood that various directional and orientational terms, such as "proximal" and "distal," "up" and "down," "front" and "back," "top" and "bottom" and "side," "length" and "width" and "thickness" and "diameter" and "cross-section" and "longitudinal," "X-" and "Y-" and "Z-," and the like, may be used herein only for convenience, and that no fixed or absolute directional or orientational limitations are intended by the use of these words. For example, the assemblies and patients can have any desired orientations. If reoriented, different directional or orientational terms may need to be used in their description, but that will not alter their fundamental nature as within the scope and spirit of the subject matter described herein in any way.

Therefore, those skilled in the art will appreciate that the invention can be practiced by other than the described embodiments, which are presented for purposes of illustration rather than of limitation.

What is claimed is:

1. A cap for a bottle, the cap comprising:

a closure operative to be coupled to the bottle for closing the bottle, the closure comprising:

a closure body defining a closure space; and a closure passageway provided through the closure body;

a base comprising a base body coupled to the closure body within the closure space, the base body and the closure body defining an indicia space within the closure space;

a dial comprising a dial body positioned within the indicia space; and a gear assembly positioned within the indicia space between a portion of the base body and a portion of the dial body, the gear assembly comprising:
a dial gear subassembly comprising a dial gear coupled to the dial body; and
a user gear subassembly comprising:
a user gear; and
a user shaft extending away from the user gear, wherein:
rotation of the user shaft is operative to rotate the user gear;
rotation of the user gear is operative to rotate the dial gear;
rotation of the dial gear is operative to rotate the dial body;
rotation of the dial body is operative to change the portion of the dial body that is aligned with the closure passageway; and
rotation of the user gear about a first axis is operative to rotate the dial gear about a second axis that is different than the first axis.

2. The cap of claim 1, wherein the second axis that is parallel to the first axis.

3. The cap of claim 1, wherein:
rotation of the dial body about the second axis is operative to change the portion of a side wall of the dial body that is aligned with the closure passageway; and
the portion of the side wall is parallel to the second axis.

4. The cap of claim 1, wherein:
rotation of the dial body about a particular axis is operative to change the portion of a top wall of the dial body that is aligned with the closure passageway; and
the portion of the top wall is perpendicular to the particular axis.

5. The cap of claim 1, wherein:
the base further comprises a base passageway provided through the base body; and
the rotation of the dial body is further operative to change the portion of the dial body that is aligned with the base passageway.

6. The cap of claim 1, wherein:
the base further comprises a shaft opening provided through the base body; and
the shaft opening enables a force external to the indicia space to be applied to the user shaft for causing the rotation of the user shaft.

7. The cap of claim 1, wherein:
the base further comprises a shaft opening provided through the base body;
the cap further comprises a handle coupled to the user shaft; and
the handle extends away from the gear assembly and out from the indicia space through the shaft opening.

8. The cap of claim 7, wherein the handle is operative to be reconfigured between:
a first state where the handle extends out from the indicia space by a first distance; and
a second state where the handle extends out from the indicia space by a second distance that is shorter than the first distance.

9. The cap of claim 1, further comprising a stopper component positioned within the indicia space, wherein the stopper component is operative to prevent rotation of the dial body in a particular direction about a particular axis.

10. The cap of claim 1, wherein a portion of the closure is movable with respect to the closure space for providing a user with access to the dial within the closure space.

11. The cap of claim 1, wherein the closure further comprises a bottle retention feature operative to be coupled to the bottle for closing the bottle.

12. A cap for a bottle, the cap comprising:
a closure operative to be coupled to the bottle for closing the bottle, the closure comprising:
a closure body defining a closure space; and
a closure passageway provided through the closure body;
a base comprising a base body coupled to the closure body within the closure space, the base body and the closure body defining an indicia space within the closure space;
a dial comprising a dial body positioned within the indicia space; and
a gear assembly positioned within the indicia space between a portion of the base body and a portion of the dial body, the gear assembly comprising:
a dial gear subassembly comprising a dial gear coupled to the dial body; and
a user gear subassembly comprising:
a user gear; and
a user shaft extending away from the user gear, wherein:
rotation of the user shaft is operative to rotate the user gear;
rotation of the user gear is operative to rotate the dial gear;
rotation of the dial gear is operative to rotate the dial body;
rotation of the dial body is operative to change the portion of the dial body that is aligned with the closure passageway;
when the gear assembly is in a resting state, rotation of the user gear is not operative to rotate the dial gear;
when the gear assembly is in an active state, rotation of the user gear is operative to rotate the dial gear; and
movement of the user gear towards the dial gear reconfigures the gear assembly from the resting state to the active state.

13. A cap for a bottle, the cap comprising:
a closure operative to be coupled to the bottle for closing the bottle, the closure comprising:
a closure body defining a closure space; and
a closure passageway provided through the closure body;
a base comprising a base body coupled to the closure body within the closure space, the base body and the closure body defining an indicia space within the closure space;
a dial comprising a dial body positioned within the indicia space; and
a gear assembly positioned within the indicia space between a portion of the base body and a portion of the dial body, the gear assembly comprising:
a dial gear subassembly comprising a dial gear coupled to the dial body; and
a user gear subassembly comprising:
a user gear; and
a user shaft extending away from the user gear, wherein:
rotation of the user shaft is operative to rotate the user gear;
rotation of the user gear is operative to rotate the dial gear;
rotation of the dial gear is operative to rotate the dial body;

rotation of the dial body is operative to change the portion of the dial body that is aligned with the closure passageway;

the base further comprises a shaft opening provided through the base body;

the cap further comprises a handle coupled to the user shaft;

the handle extends away from the gear assembly and out from the indicia space through the shaft opening; and the handle is not accessible to a user when the bottle is closed by the closure.

14. A cap for a bottle, the cap comprising:

a closure operative to be coupled to the bottle for closing the bottle;

a base coupled to the closure;

a dial positioned between a portion of the base and a portion of the closure; and a gear assembly positioned between a portion of the base and a portion of the dial, the gear assembly comprising:

a dial gear subassembly coupled to the dial; and a user gear subassembly, wherein:

the dial gear subassembly comprises a dial gear comprising dial gear teeth;

the user gear subassembly comprises a user gear comprising user gear teeth;

the gear assembly is operative to translate movement of the user gear subassembly into movement of the dial gear subassembly when the user gear teeth are meshed with the dial gear teeth;

the gear assembly is operative to translate movement of the user gear subassembly into movement of the dial gear subassembly for moving the dial with respect to the closure;

the base is operative to hold the user gear subassembly at a first position where the user gear teeth are not meshed with the dial gear teeth; and the gear assembly requires application of a force on the user gear subassembly to move the user gear subassembly from the first position to a second position where the user gear teeth are meshed with the dial gear teeth.

15. The cap of claim 14, wherein movement of the dial with respect to the closure is operative to change the portion of indicia on the dial that is aligned with a passageway through one of the closure and the base.

* * * * *